US008406652B2

(12) United States Patent
Funada et al.

(10) Patent No.: US 8,406,652 B2
(45) Date of Patent: Mar. 26, 2013

(54) REMOVABLE MEMBER-HOLDING DEVICE AND IMAGE FORMING APPARATUS

(75) Inventors: Atsushi Funada, Kanagawa (JP); Hirokazu Murase, Kanagawa (JP); Hiroaki Okuma, Kanagawa (JP); Ryuji Hattori, Kanagawa (JP); Junichi Hama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 389 days.

(21) Appl. No.: 12/553,448

(22) Filed: Sep. 3, 2009

(65) Prior Publication Data

US 2010/0215407 A1 Aug. 26, 2010

(30) Foreign Application Priority Data

Feb. 26, 2009 (JP) ..... 2009-044616
Mar. 19, 2009 (JP) ..... 2009-068904
Mar. 19, 2009 (JP) ..... 2009-068919
Mar. 19, 2009 (JP) ..... 2009-068938

(51) Int. Cl.
*G03G 15/00* (2006.01)

(52) U.S. Cl. ..... 399/110; 399/111

(58) Field of Classification Search ..... 399/110, 399/111, 113, 120, 258; 222/DIG. 1
See application file for complete search history.

(56) References Cited

U.S. PATENT DOCUMENTS 5,173,686 A * 12/1992 Fujihara ..... 345/87
5,734,953 A 3/1998 Tatsumi
5,822,663 A 10/1998 Ichikawa et al.
6,266,505 B1 7/2001 Ban et al.
6,882,817 B2 4/2005 Kita
2002/0122676 A1 9/2002 Yamada et al.
2003/0215267 A1 11/2003 Kita
2008/0219696 A1 9/2008 Itabashi

FOREIGN PATENT DOCUMENTS

CN 1152138 A 6/1997
CN 1204786 A 1/1999
CN 1374569 A 10/2002

(Continued)

OTHER PUBLICATIONS

Office Action, dated Oct. 30, 2012, issued by the State Intellectual Property Office of the P.R.C. in counterpart Chinese Application No. 200910174394.1

*Primary Examiner* — Walter L Lindsay, Jr.
*Assistant Examiner* — Barnabas Fekete
(74) *Attorney, Agent, or Firm* — Sughrue Mion, PLLC

(57) ABSTRACT

A removable member-holding device is provided and includes: a pull-out member that is supported so as to be movable between an accommodation position and a pull-out position; a rotatable holder that is supported by the pull-out member so as to be rotatable around a rotation shaft and supported so as to be movable integrally with the pull-out member, and that holds a removable member which is attached to and detached from the image forming apparatus main body, the rotatable holder being movable between an insertion possible position where the pull-out member is movable from the pull-out position toward the accommodation position and an inclined position where the rotatable holder rotates downward in a direction of a gravity around the rotation shaft and is inclined with respect to the insertion possible position; and a regulating member that is disposed at the rotation shaft of the rotatable holder to lessen a movement speed of the rotatable holder when rotationally moving to the inclined position.

14 Claims, 26 Drawing Sheets

FOREIGN PATENT DOCUMENTS

| | | | |
|---|---|---|---|
| CN | 100350330 | C | 11/2007 |
| EP | 0856780 | A1 | 8/1998 |
| EP | 1589384 | A2 | 10/2005 |
| JP | 10-213959 | | 8/1998 |
| JP | 11-143190 | | 5/1999 |
| JP | 2000-275946 | | 10/2000 |
| JP | 2003-66705 | | 3/2003 |
| JP | 2003-114568 | | 4/2003 |
| JP | 2003-295591 | | 10/2003 |
| JP | 2004-126407 | | 4/2004 |
| JP | 2006-78627 | | 3/2006 |
| JP | 2006-215239 | | 8/2006 |
| JP | 3952705 | B | 5/2007 |

* cited by examiner

KHk
Kk
Kk1
Kk2
Kk3
Kk4
Kk2a
Kk6
Kk7
RTk
1
1a
2
2a
2b
2d
6
7
8
9
12
12a
16
17
18
19
21
21a
21b
21c
22
23
24
31
61
63
63c
62b
63d
64
64a
71
72
76
76c
81
82
83
88
Z
(−Z)
X
(−X)
Y
(−Y)

REMOVABLE MEMBER-HOLDING DEVICE AND IMAGE FORMING APPARATUS

CROSS-REFERENCE TO RELATED APPLICATION

This application is based on and claims priority under 35 USC §119 from Japanese Patent Application No. 2009-044616 filed Feb. 26, 2009 and Japanese Patent Application Nos. 2009-068904, 2009-068919 and 2009-068938 filed Mar. 19, 2009.

BACKGROUND (i) Technical Field

The present invention relates to a removable member-holding device and an image forming apparatus. In particular, the present invention relates to a holding device for a removable member, such as a cartridge or the like.

(ii) Related Art

In an image forming apparatus, such as a copy machine or a printer, expendable supplies can be replaced as a removable member with expendable supplies.

The removable member means a unit which is detachably mounted in the apparatus main body. For example, like a photosensitive unit which has a photosensitive member, a charger, and a cleaning member integrally attached to and detached from the apparatus main body, a plural functional components in the image forming apparatus may be configured as a single unit so as to be integrally attached to and detached from the apparatus main body. Further, like a toner cartridge, each functional component may be configured so as to be attached to and detached from the apparatus main body.

SUMMARY

According to a first aspect of the invention, a removable member-holding device includes: a pull-out member that is supported so as to be movable between an accommodation position where the pull-out member is accommodated in an image forming apparatus main body and a pull-out position where the pull-out member is pulled out from the accommodation position outward of the image forming apparatus main body; a rotatable holder that is supported by the pull-out member so as to be rotatable around a rotation shaft and supported so as to be movable integrally with the pull-out member and that holds a removable member which is attached to and detached from the image forming apparatus main body, wherein the rotatable holder is movable between an insertion possible position where the pull-out member is movable from the pull-out position toward the accommodation position and an inclined position where the rotatable holder rotates downward in a direction of a gravity around the rotation shaft and is inclined with respect to the insertion possible position; and a regulating member that is disposed at the rotation shaft of the rotatable holder to lessen a movement speed of the rotatable holder when rotationally moving to the inclined position.

BRIEF DESCRIPTION OF THE DRAWINGS

Exemplary embodiments of the present invention will be described in detail based on the following figures, wherein:

FIG. 3A is a perspective view of a state where a toner dispenser device is moved to an accommodation position where the toner dispenser device is accommodated in the image forming apparatus, FIG. 3B is an explanatory view of a state where an outlet port of a toner cartridge and an inlet port of a toner dispenser device are connected to each other, and FIG. 3C is an explanatory view of a state where a toner cartridge is rotated from the state in FIG. 3B;

FIG. 8A is an explanatory view when viewed from the direction of the arrow VIII in FIG. 4, and FIG. 8B is a sectional view taken along the line VIIIB-VIIIB in FIG. 6;

FIG. 11A is an explanatory view of the main portions of a front portion of the inclined holder when being moved to an insertion possible position in FIG. 4, and FIG. 11B is a sectional view taken along the line XIB-XIB in FIG. 11A;

FIG. 20A is a perspective view, FIG. 20B is a sectional view taken along the line XXB-XXB in FIG. 20A, and FIG. 20C is a sectional view taken along the line XXC-XXC in FIG. 20A;

FIG. 23A is an explanatory view of an opening for rotation position adjustment when the rotation position adjusting member is removed, FIG. 23B is an explanatory view of a rotation position adjusting member for a shallow rotation position, FIG. 23C is an explanatory view of a rotation position adjusting member for a middle rotation position, and FIG. 23D is an explanatory view of a rotation position adjusting member for a deep rotation position;

DETAILED DESCRIPTION

Figure 1:
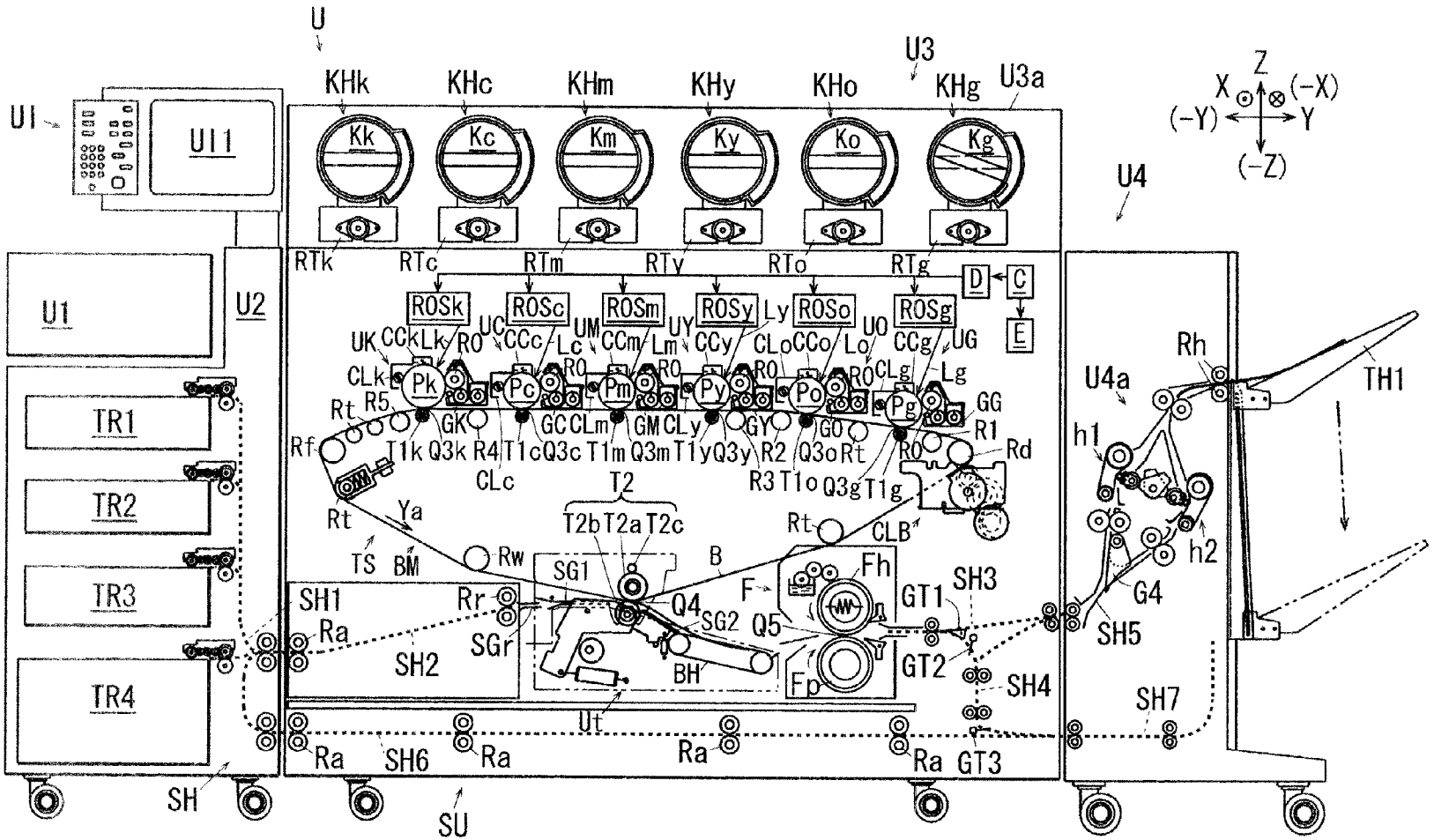
FIG. 1 is an explanatory view of the whole of an image forming apparatus according to a first exemplary embodiment of the invention.

Exemplary embodiments of the invention (hereinafter, referred to as embodiments) will now be described with reference to the drawings. However, the invention is not limited to the following embodiments.

For easy understanding of the following description, in the drawings, the front-back direction is referred to as an X-axis direction, the left-right direction is referred to as a Y-axis direction, and the up-down direction is referred to as a Z-axis direction. Directions or sides which are represented by X, −X, Y, −Y, Z, and −Z are respectively referred to as a front direction, a rear direction, a right direction, a left direction, an upper direction, and a lower direction, or a front side, a rear side, a right side, a left side, an upper side, and a lower side.

In the drawings an indication in which "•" is marked in "O" means an arrow which goes from the back of the figure toward the front thereof, and an indication in which "x" is marked in "O" means an arrow which goes from the front of the figure toward the back thereof.

In the following description using the drawings, for easy understanding of the description, other members than the members that are necessary for description are appropriately omitted.

First Embodiment

FIG. 1 is an explanatory view of the whole of an image forming apparatus according to a first exemplary embodiment of the invention.

Referring to FIG. 1, an image forming apparatus U of the first embodiment has a user interface UI which is an example of an apparatus operating unit, an image input device U1 which is an example of an image information input device, a sheet feed device U2, an image forming apparatus main body U3, and a sheet processing device U4.

The user interface UI has input keys, such as a copy start key which is an example of an image formation start button, copies set key which is an example of an image formation copies set button, a numeric keypad which is an example of a numeral input button, and the like, and a display unit UI1.

The image input device U1 has an automatic document feeder, an image scanner which is an example of an image reading device, and the like. Referring to FIG. 1, the image input device U1 reads a document (not shown) for conversion to image information, and inputs the image information to the image forming apparatus main body U3.

The sheet supply device U2 is configured such that sheet supply trays TR1 to TR4, which are examples of a plural sheet supply units, are detachably supported. Each of the sheet supply trays TR1 to TR4 stores a recording sheet S which is an example of a final transfer member or a medium. The recording sheet S is supplied from each of the sheet supply trays TR1 to TR4 and transported to the image forming apparatus main body U3 through a sheet feed path SH1 and the like.

Referring to FIG. 1, the image forming apparatus main body U3 has an image recording unit which records an image on the recording sheet S transported from the sheet feed device U2, a toner dispenser device U3*a* which is an example of a developer replenishing device, a sheet transport path SH2, a sheet output path SH3, a sheet reversal path SH4, a sheet circulation path SH6, and the like.

The image forming apparatus main body U3 also has a control portion C, a laser driving circuit D which is an example of a latent image writing device driving circuit and which is controlled by the control portion C, a power supply circuit E which is controlled by the control portion C, and the like. The laser driving circuit D outputs laser driving signals based on image information of G: green, O: orange, Y: yellow, M: magenta, C: cyan, and K: black input from the image input device U1 to latent image forming devices ROSg, ROSo, ROSy, ROSm, ROSc, and ROSk of the respective colors at a preset time or so-called timing.

Below the latent image forming devices ROSg to ROSk of the respective colors, image carrier units UG, UO, UY, UM, UC, and UK of the respective colors, and developing units GG, GO, GY, GM, GC, and GK of the respective colors which are an example of a developing device are detachably mounted, respectively.

The image carrier unit UK of black has a photosensitive drum Pk which is an example of an image carrier, a charger CCk, and a cleaner CLk which is an example of a cleaner for an image carrier. On the right side of the photosensitive drum Pk, a developing roller R0 which is an example of a developing member of the developing unit GK of black is disposed close to the photosensitive drum Pk. The image carrier units UG to UC of other colors respectively have photosensitive drums Pg, Po, Py, Pm, and Pc, chargers CCg, CCo, CCy, CCm, and CCc, and cleaners CLg, CLo, CLy, CLm, and CLc. On the right side of each of the photosensitive drums Pg to Pc, a developing roller R0 which is an example of a developing member of a corresponding one of the developing units GG to GC of the respective colors is disposed close to the corresponding photosensitive drum.

In the first embodiment, the photosensitive drum Pk of the K color, which is frequently used and the surface of which is more worn away, is configured so as to have a diameter larger than the photosensitive drums Pg to Pc of other colors so as to achieve high-speed rotation and an extension of lifespan.

The image carrier units UY to UO and the developing units GY to GO respectively form visible image forming members (UG+GG), (UO+GO), (UY+GY), (UM+GM), (UC+GC), and (UK+GK).

Referring to FIG. 1, after the photosensitive drums Pg to Pk are charged uniformly by the chargers CCg to CCk, respectively, electrostatic latent images are formed on the surfaces of the photosensitive drums Pg to Pk by laser beams Lg, Lo, Ly, Lm, Lc, and Lk which are an example of laser image writing light and output from the latent image forming devices ROSg to ROSk, respectively. The electrostatic latent images on the surfaces of the photosensitive drums Pg to Pk are developed into toner images, which are examples of images of G: green, O: orange, Y: yellow, M: magenta, C: cyan, and K: black or visible images, by the developing units GG to GK.

The toner images on the surfaces of the photosensitive drums Pg to Pk are transferred so as to be sequentially superimposed on an intermediate transfer belt B, which is an example of an intermediate transfer member, by primary transfer rollers T1*g*, T1*o*, T1*y*, T1*m*, T1*c*, and T1*k*, which are an example of a primary transfer member, in primary transfer regions Q3*g*, Q3*o*. Q3*y*, Q3*m*, Q3*c*, and Q3*k*, respectively, then, a multi-color image or a so-called color image is formed on the intermediate transfer belt B. The color image which is formed on the intermediate transfer belt B is transported to a secondary transfer region Q4.

In the case of black image data, only the photosensitive drum Pk and the developing unit GK of black are used, and only a toner image of black is formed. When four-color printing using the colors of Y, M, C, and K, or two-color or three-color printing based on the user's setting is performed, corresponding members of the photosensitive drums Pg and Pk and the developing units GG to GK are used.

After the primary transfer, residual toner on the surfaces of the photosensitive drums Pg to Pk is cleaned by the cleaners CLg to CLk for a photosensitive drum, respectively, and the photosensitive drums Pg to Pk are charged again by the chargers CCg to CCk, respectively.

As the developer is consumed by the developing units GG to GK, developer is replenished from toner cartridges Kg, Ko, Ky, Km, Kc, Kk which are an example of a removable member and mounted on the toner dispenser device U3*a* and an example of a developer accommodating container.

Figure 2:
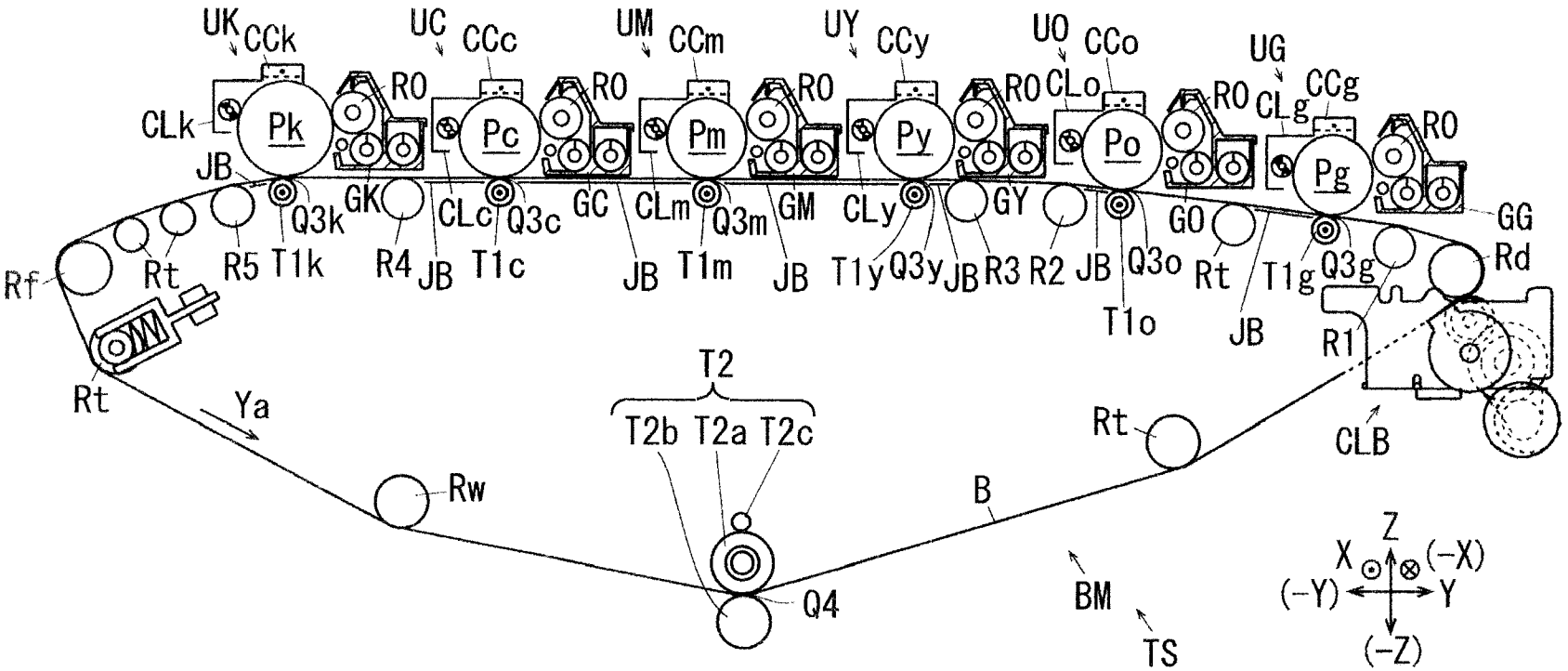
FIG. 2 is an explanatory view of the whole of a belt module according to the first exemplary embodiment of the invention.

FIG. 2 is an explanatory view of the whole of a belt module according to the first embodiment of the invention.

Referring to FIGS. 1 and 2, below the photosensitive drums Pg to Pk, a belt module BM, which is an example of an intermediate transfer device, is supported so as to ascend and descend between an ascent position where the belt module BM comes into contact with the lower surfaces of the photosensitive drums Pg to Pk and a descent position where the belt module BM is lower than the lower surfaces of the photosensitive drums Pg to Pk.

The belt module BM has the intermediate transfer belt B. The intermediate transfer belt B is driven to rotate in the direction of an arrow Ya by a belt driving roller Rd, which is an example by an intermediate transfer member driving member supporting the intermediate transfer belt B from the rear surface, and is stretched with tension by a tension roller Rt, which is an example of a tension providing member. The rear surface of the intermediate transfer belt B is supported by a working roller Rw which is an example of a skewed movement preventing member used for preventing the skewed movement of the intermediate transfer belt B, a plurality of idle rollers Rf which are an example of a driven member, or a backup roller T2*a* which is an example of a secondary transfer opposing member.

In the first embodiment, on the upstream side in the direction of the arrow Ya of the primary transfer roller T1*g* of the G color, a first retraction roller R1 which is an example of an intermediate transfer member support member for contact and separation and is movably supported in the direction in which the intermediate transfer belt B comes into contact with and is separated from the photosensitive drum Pg with respect to the direction of the arrow Ya. On the downstream in the direction of the arrow Ya of the primary transfer roller T1*o* of the O color and on the upstream side in the direction of the arrow Ya of the primary transfer roller T1*y* of the Y color a second retract roller R2 and a third retract roller R3, which are an example of the intermediate transfer member support member and have the same configuration as the first retract roller R1, are disposed in parallel. On the downstream side in the direction of the arrow Ya of the primary transfer roller T1*c* of the C color and the upstream side in the direction of the arrow Ya of the primary transfer roller T1*k* of the K color, a fourth retract roller R4, which has the same configuration as the first retract roller R1 and is an example of the intermediate transfer member support member for contact and separation, is disposed. On the downstream side in the direction of the arrow Ya of the primary transfer roller T1*k* of the K color, a fifth retract roller R5, which has the same configuration as the first retract roller R1 and is an example of the intermediate transfer member support member for contact and separation, is disposed.

On the downstream side in the direction of the arrow Ya of the primary transfer rollers T1*g* to T1*k*, a charge erase plate JB, which is an example of a erasing member for removing the charges on the rear surface of the intermediate transfer belt B, is disposed. The charge erase plate JB of the first embodiment is disposed so as not to come into contact with the intermediate transfer belt B. For example the charge erase plate JB may be disposed at a position 2 mm away from the rear surface of the intermediate transfer belt B.

The rollers Rd, Rt, Rw, Rf, T2*a*, and R1 to R5 form belt support rollers Rd, Rt, Rw, Rf, T2*a*, and R1 to R5 which are an example of an intermediate transfer member support member for rotatably supporting the intermediate transfer belt B from the rear surface.

The intermediate transfer belt B, the belt support rollers Rd, Rt, Rw, Rf, T2*a*, and R1 to R5, the primary transfer rollers T1*g* to T1*k*, the charge erase plate JB, and the like form the belt module BM of the first embodiment.

Below the backup roller T2*a*, a secondary transfer unit Ut is disposed. A secondary transfer roller T2*b* which is an example of a secondary transfer member of the secondary transfer unit Ut is disposed so as to be separated from and come into contact with the backup roller T2*a* with the intermediate transfer belt B sandwiched therebetween. The secondary transfer region Q4 is formed in a region where the secondary transfer roller T2*b* is pressed into contact with the intermediate transfer belt B. A contact roller T2*c*, which is an example of a contact member for voltage application, is in contact with the backup roller T2*a*, and the rollers T2*a* to T2*c* form a secondary transfer unit T2 which is an example of a final transfer member.

A secondary transfer voltage which has the same polarity as the toner charging polarity is applied from the power supply circuit, which is controlled by the control portion C, to the contact roller T2*c* at predetermined timing.

Below the belt module BM, the sheet transport path SH2 is disposed. The recording sheet S, which is fed from the sheet feed path SH1 of the sheet feed device U2, is transported to the sheet transport path SH2, and then to the secondary transfer region Q4 through a medium guide member SGr and a before-transfer medium guide member SG1 by a registration roller Rr, which is an example of a sheet feed time control member, when the toner images are transported to the secondary transfer region Q4.

The medium guide member SGr is fixedly supported by the image forming apparatus main body U3, together with the registration roller Rr.

The toner image on the intermediate transfer belt B is transferred to the recording sheet S by the secondary transfer unit T2 when passing through the secondary transfer region Q4. In the case of a full color image, the toner images which are primarily transferred to the surface of the intermediate transfer belt B in an overlap manner are secondarily transferred together to the recording sheet S.

After the secondary transfer, the intermediate transfer belt B is cleaned by a belt cleaner CLB which is an example of an intermediate transfer member cleaner. The secondary transfer roller T2*b* and the belt cleaner CLB are supported so as to be separated and come into contact with the intermediate transfer belt B.

The belt module BM, the secondary transfer unit T2, the belt cleaner CLB, and the like form a transfer device TS which transfers the image on the surface of each of the photosensitive drums Py to Po to the recording sheet S.

The recording sheet S to which the toner image is secondarily transferred is transported to a fixing device F through an after-transfer medium guide member SG2 and a sheet transport belt BH, which is an example of a before-fixing medium transport member. The fixing device F has a heating roller Fh which is an example of a heating fixing member, and a pressing roller Fp which is an example of a pressing fixing member. A fixing region Q5 is formed in a region where the heating roller Fh and the pressing roller Fp are pressed into contact with each other.

The toner image on the recording sheet S is heated and fixed by the fixing device F when passing through the fixing region Q5. On the downstream side of the fixing device F, a transport path switching member GT1 is provided. The transport path switching member GT1 selectively switches a path for the recording sheet S, which is transported from the sheet transport path SH2 and on which the toner image is heated and fixed in the fixing region Q5, to either the sheet output path SH3 of the sheet processing device U4 or the sheet reversal path SH4. The recording sheet S which is transported to the sheet output path SH3 is transported to the sheet transport path SH5 of the sheet processing device U4.

In the sheet transport path SH5, a curl correction device U4*a* is disposed, and a switching gate G4 which is an example of a transport path switching member is disposed in the sheet transport path SH5. The switching gate G4 transports the recording sheet S, which is transported from the sheet output path SH3 of the image forming apparatus main body U3, to either a first curl correction member h1 or a second curl correction member h2 in accordance with the direction of curvature or so-called curl. When the recording sheet S which is transported to the first curl correction member h1 or the second curl correction member h2 passes therethrough, the curl is corrected. The recording sheet S in which the curl has been corrected is discharged from a discharge roller Rh, which is an example of a discharge member, to a discharge tray TH1, which is an example of a discharge portion of the sheet processing device U4, in a state where the image fixing surface of the sheet is directed upward or a so-called face-up state.

The recording sheet S which is transported to the sheet reversal path SH4 of the image forming apparatus main body U3 by the transport path switching member GT1 passes through a transport direction regulating member having an elastic thin-film member or a so-called mylar gate GT2 while pushing aside the transport direction regulating member, and is then transported to the sheet reversal path SH4 of the image forming apparatus main body U3.

The sheet circulation path SH6 and the sheet reversal path SH7 are connected to the downstream end of the sheet reversal path SH4 of the image forming apparatus main body U3, and a mylar gate GT3 is disposed in the connection portion. The recording sheet S which is transported to the sheet transport path SH4 through the switching gate GT1 passes through the mylar gate GT3 and is transported to the sheet reversal path SH7 of the sheet processing device U4. In the case of duplex printing, the recording sheet S which is transported from the sheet reversal path SH4 once passes through the mylar gate GT3 and is transported to the sheet reversal path SH7, and thereafter is reversely transported or subjected to a so-called switch-back operation. Thus, the transport direction is regulated by the mylar gate GT3, and the recording sheet S which is switched back is transported to the sheet circulation path SH6. The recording sheet S which is transported to the sheet circulation path SH6 passes through the sheet feed path SH1 and is sent to the transfer region Q4 again.

When the recording sheet S which is transported from the sheet reversal path SH4 is switched back after the trailing end of the recording sheet S passes through the mylar gate GT2 and before the trailing end of the recording sheet S passes through the mylar gate GT3, the transport direction of the recording sheet is regulated by the mylar gate GT2, and the recording sheet is transported to the sheet transport path SH5 in a state where the sides thereof are inverted. The inverted recording sheet is subjected to curl correction by the curl correction device U4*a* and can be then discharged to the sheet discharge tray TH1 of the sheet processing device U4 in a state where the image fixing surface of the recording sheet is directed downward or a face-down state.

The members to which the reference numerals SH1 to SH7 are given form the sheet transport path SH. The members to which the reference numerals SH, Ra, Rr, Rh, SGr, SG1, SG2, BH, and GT1 to GT3 are given form a sheet transport device SU.

(Toner Dispenser Device U3*a*)

Referring to FIG. 1, the toner dispenser device U3*a* of the first embodiment has cartridge holders KHg, KHo, KHy, KHm, KHc, and KHk in which the toner cartridges Kg to Kk of the colors of G, O, Y, M, C, and K are mounted, and reserve tanks RTg, RTo, RTy, RTm, RTc, and RTk which are an example of a developer storing container, in which developer from the cartridges Kg to Kk is temporarily stored and stirred. The developer which is stirred in the reserve tanks RTg to RTk is transported by a transport member (not shown) in accordance with the amount of consumption of the developer by the developing units GG to OK.

Next, the cartridge holders KHg to KHk which are an example of a removable member-holding device of the first embodiment will be described. The cartridge holders KHg to KHk have the same configuration, so only the cartridge holder KHk of the K color will be described, and detailed descriptions of the cartridge holders KHg to KHc of other colors will be omitted.

Figures 3A, 3B, 3C:
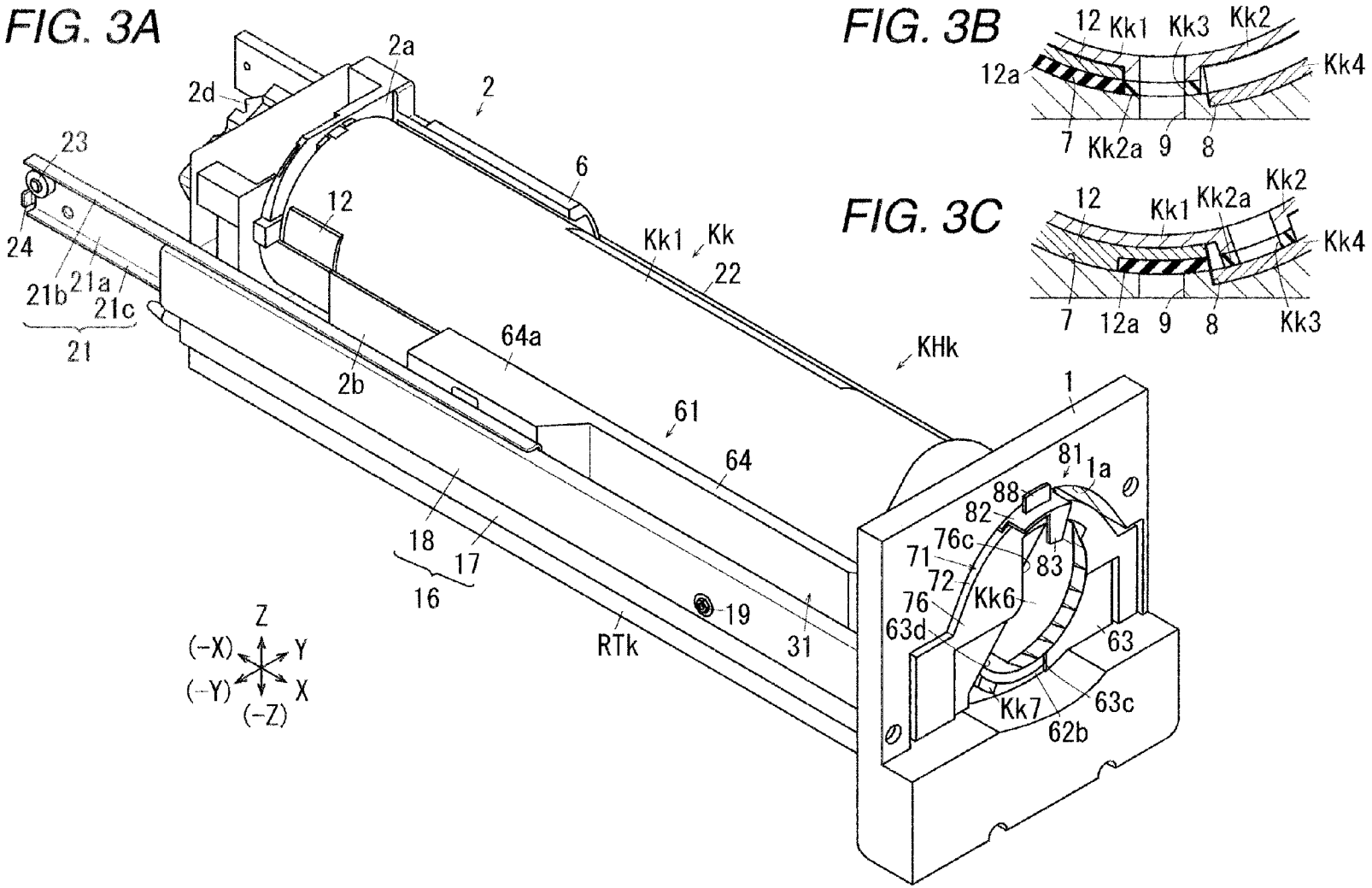
FIGS. 3A to 3C are explanatory perspective views of the main portions of a toner dispenser device according to the first exemplary embodiment, specifically.

FIGS. 3A to 3C are explanatory perspective views of the main portions of a toner dispenser device according to the first embodiment. Specifically. FIG. 3A is a perspective view of a state where a toner dispenser device is moved to an accommodation position where the toner dispenser device is accommodated in the image forming apparatus, FIG. 3B is an explanatory view of a state where an outlet port of a toner cartridge and an inlet port of a toner dispenser device are connected to each other, and FIG. 3C is an explanatory view of a state where a toner cartridge is rotated from the state in FIG. 3B.

Figure 4:
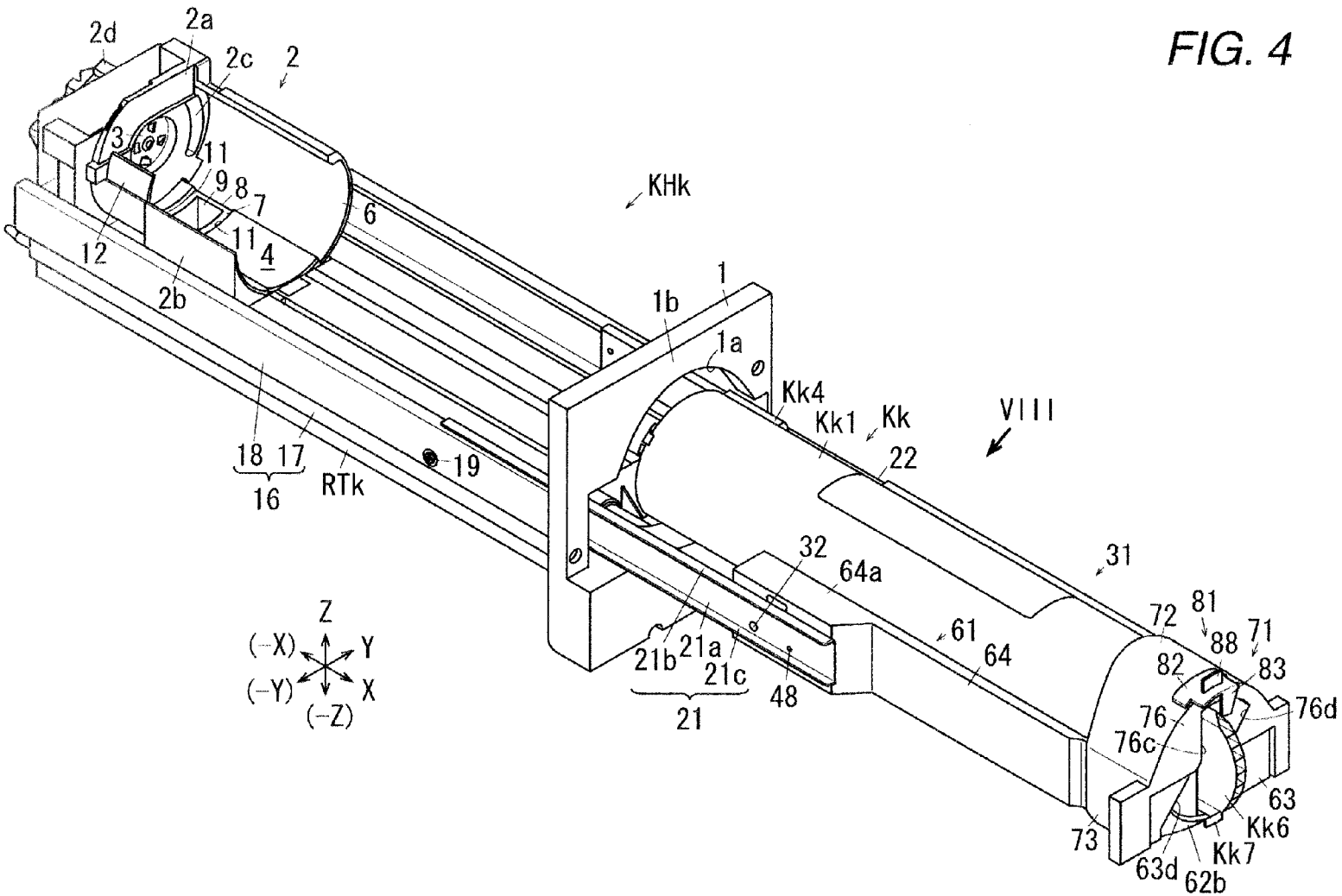
FIG. 4 is an explanatory perspective view of the main portions of the toner dispenser device according to the first exemplary embodiment, and an explanatory view of a state where an inclined holder is pulled out and moved from the state in FIGS. 3A to 3C to a pull-out position.

FIG. 4 is an explanatory perspective view of the main portions of the toner dispenser device according to the first embodiment, and an explanatory view of a state where an inclined holder is pulled out and moved from the state in FIGS. 3A to 3C to a pull-out position.

Figure 5:
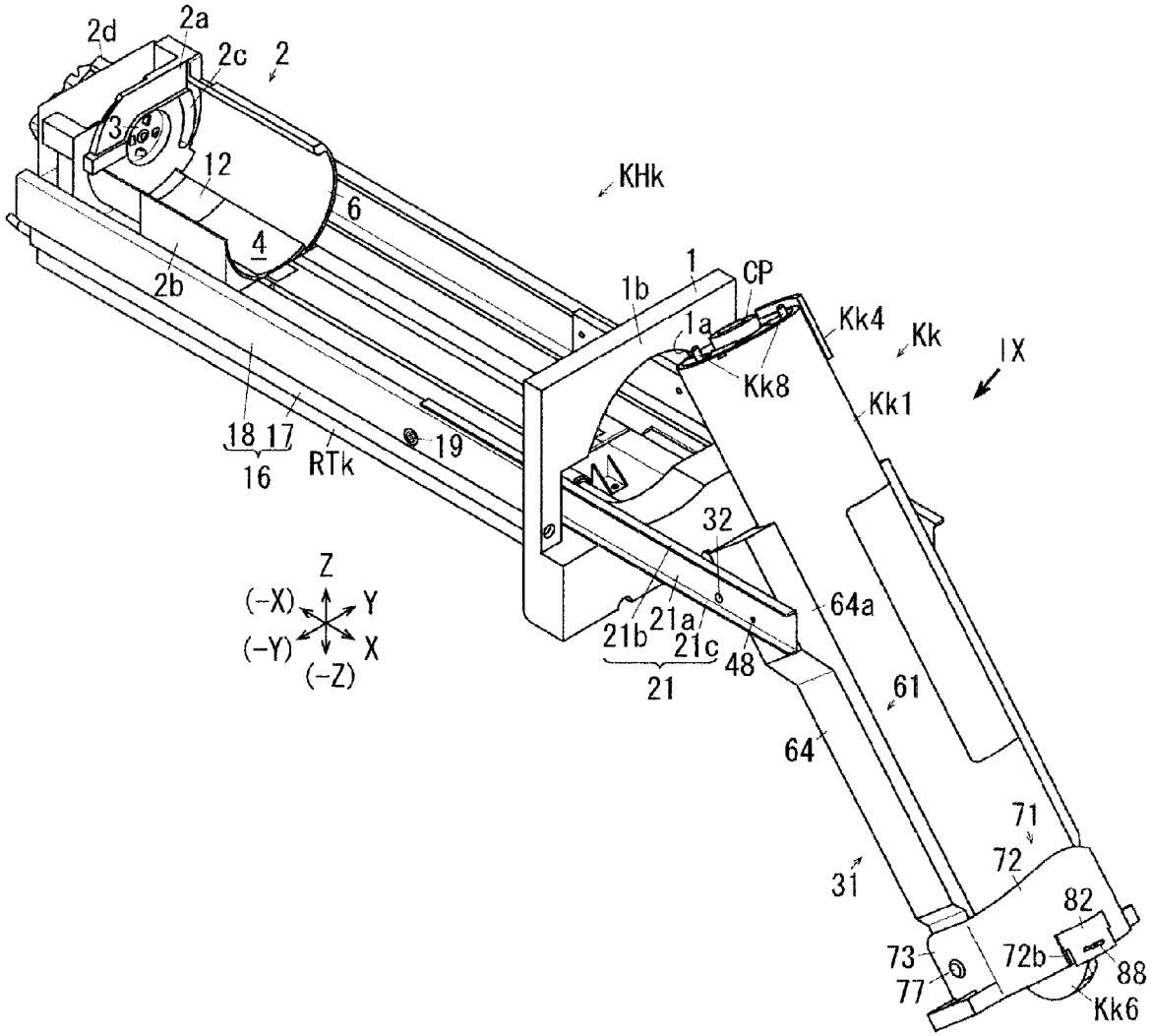
FIG. 5 is an explanatory perspective view of the main portions of the toner dispenser device according to the first exemplary embodiment, and an explanatory view of a state where an inclined holder is moved from the state in FIG. 4 to an inclined position.

FIG. 5 is an explanatory perspective view of the main portions of the toner dispenser device according to the first embodiment, and an explanatory view of a state where an inclined holder is moved from the state in FIG. 4 to an inclined position.

Figure 6:
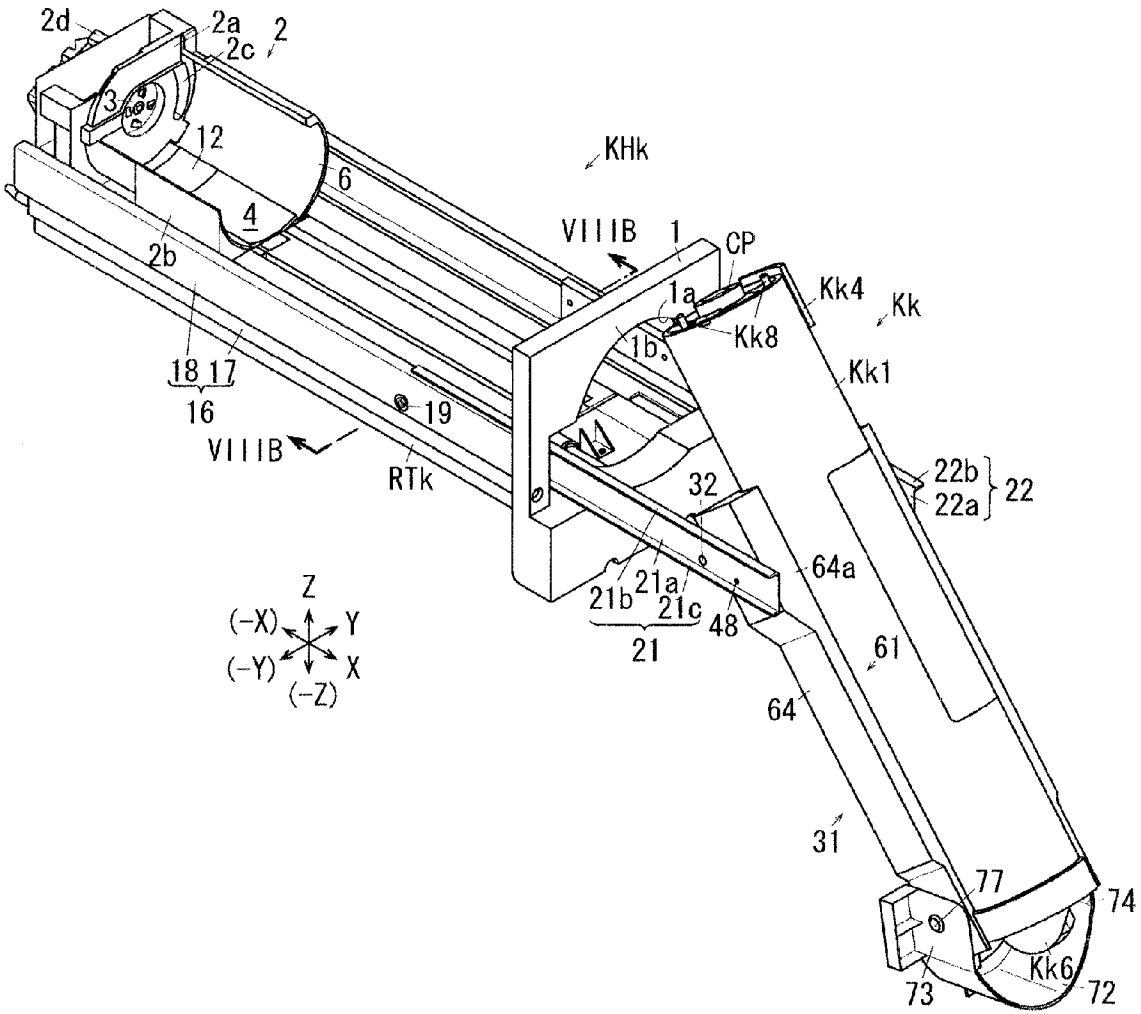
FIG. 6 is an explanatory perspective view of the main portions of the toner dispenser device according to the first exemplary embodiment, and an explanatory view of a state where a front end cover is moved from the state in FIG. 5 to a front end opening position.

FIG. 6 is an explanatory perspective view of the main portions of the toner dispenser device according to the first embodiment, and an explanatory view of a state where a front end cover is moved from the state in FIG. 5 to a front end opening position.

Figure 7:
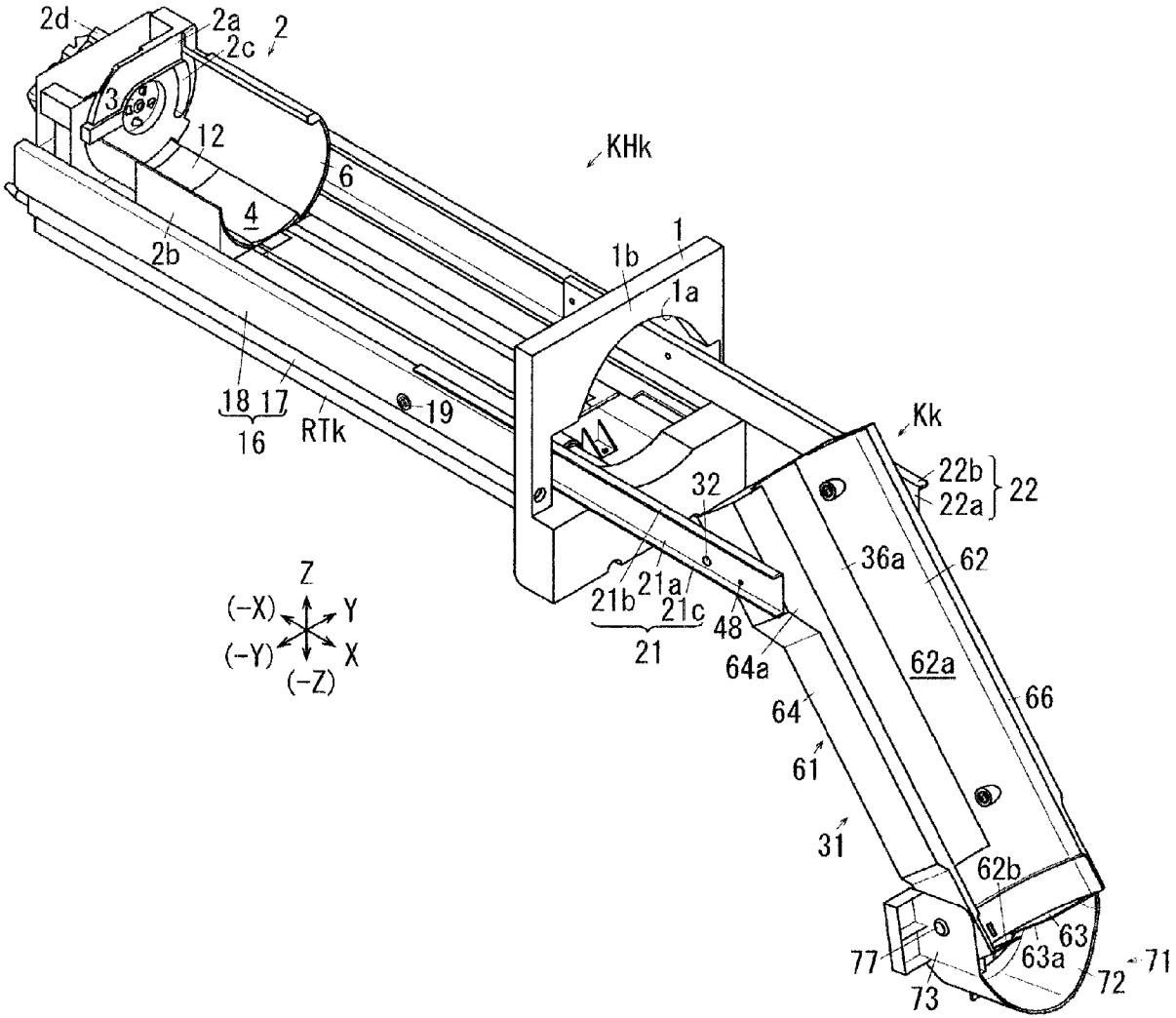
FIG. 7 is an explanatory perspective view of the main portions of the toner dispenser device according to the first exemplary embodiment, and an explanatory view of a state a toner cartridge is removed from the state in FIG. 6.

FIG. 7 is an explanatory perspective view of the main portions of the toner dispenser device according to the first embodiment, and an explanatory view of a state a toner cartridge is removed from the state in FIG. 6.

Although a main body-side shutter is moved to an outlet port closing position, for easy understanding, FIG. 4 shows a state where the main body-side shutter is moved to an outlet port opening position.

Referring to FIG. 1 and FIGS. 3A to 7, the cartridge holder KHk of the K color has a front-side frame 1 which is an example of a front end frame body and is fixedly supported by the image forming apparatus main body U3, and a holder base 2 which is a fixed member disposed at a rear end portion of the reserve tank RTk. Referring to FIGS. 3A to 7, a circular hole-shaped opening 1*a* through which the toner cartridge Kk, which is mounted on the front-side frame 1, passes is formed in the front-side frame 1. Referring to FIGS. 4 to 7, the holder base 2 has a plate-shaped rear end wall 2*a* which is disposed at the rear end portion, and a semicylinder-shaped cylindrical wall 2*b* which extends forward from the rear end wall 2*a*.

At the read end wall 2*a*, a hard key mounting groove 2*c*, which is an example of a main body-side erroneous mounting preventing portion and has an arc-shaped groove, is formed, and a hard key Kk8 which is an example of a removable member-side erroneous mounting preventing portion and projects rearward from the rear end of the toner cartridge Kk is fitted into the hard key mounting groove 2*c*. Thus, the toner cartridges Kg to Kk are mounted which accommodate developer corresponding to the colors of the developing units Gg to Gk, the hard key mounting groove 2*c* and the hard key Kk8 are aligned and fitted with each other. When the colors are not identical, the hard key mounting groove 2*c* and the hard key Kk8 are set in advance so as to be misaligned and not to be fitted with each other.

A coupling, 3 which is an example of a driving transmission member, to which the driving from a driving source 2*d* is transmitted, is supported by the rear end wall 2*a*. The coupling 3 is meshed with a coupling CP shown in FIG. 5, which is an example of a member, to which the driving is transmitted, at the rear end of the toner cartridge Kk to be mounted to transmit rotation to a developer transport member (not shown) in the toner cartridge Kk.

The cylindrical wall 2*b* of the holder base 2 has an arc-shaped inner circumferential surface 4 which extends from the bottom to the left side, and a shutter passage groove 6 which is formed at the right portion of the inner circumferential surface 4 to be more concave than the inner circumferential surface 4, and is an example of an opening/closing member passage and extends in the front-back direction. At the rear end portion of the inner circumferential surface 4, an inlet port forming portion 7 which is formed to be more concave than the arc-shaped inner circumferential surface 4 and more convex than the shutter passage groove 6, and extends along the circumferential direction of the cylindrical wall 2*b*. A step portion at the boundary between the inlet port forming portion 7 and the shutter passage groove 6 forms a shutter holding portion 8 which is an example of an opening/closing member holding portion.

At the inlet port forming portion 7, an inlet port 9 is formed which is connected to the underlying reserve tank reserve tank RTk. On both sides of the inlet port 9 in the front-back direction, main body-side guides 11 are formed which are an example of a shield member guide portion and are formed in an arc shape along the inner circumferential surface 4 of the cylindrical wall 2*b*. An arc-shaped main body-side shutter 12 along the inner circumferential surface of the cylindrical wall 2*b* is supported so as to be movable in the circumferential direction by the main body-side guides 11. The main body-side shutter 12 is urged in a direction for closing the inlet port 9 by a spring (not shown) and is supported so as to be movable between an inlet port opening position shown in FIG. 3B where the inlet port 9 is open and an inlet port closing position shown in FIG. 3C where the inlet port 9 is closed. Referring to FIGS. 3B and 3C, a main body seal 12*a* which is an example of a leakage preventing member is supported on the inlet port 9 side of the main body-side shutter 12.

Referring to FIGS. 3A to 4, the toner cartridge Kk which is mounted on the holder base 2 of the first embodiment has a cylindrical container main body Kk1. Referring to FIGS. 3B and 3C, an outlet port portion Kk2 is formed at the rear end portion of the container main body Kk1 to project outward in the diameter direction of the container main body Kk1. An outlet port Kk3 through which the developer in the container main body Kk1 flows out is formed at the outlet port portion Kk2, and a cartridge seal Kk2*a* which is an example of a leakage preventing member is supported at the outer end of the outlet port portion Kk2 so as to surround the outlet port Kk3. A cartridge shutter Kk4, which is an example of an opening/closing member and is movable along the circumferential direction of the container main body Kk1 is mounted in the outlet port portion Kk2. The recess of the shutter passage groove 6 of the holder base 2 is formed to have such a depth that the cartridge shutter Kk4 can pass therethrough when the outlet port Kk3 is closed. The recess of the inlet port forming portion 7 is formed to have a depth smaller than the thickness of the cartridge shutter Kk4, and a depth larger than the projection amount of the outlet port portion Kk2 from the container main body Kk1.

Therefore, as indicated by the outlet port closing position in FIG. 3C and FIGS. 5 to 7, if the toner cartridge Kk1 is inserted, the cartridge shutter Kk4 can pass through the shutter passage groove 6 and be mounted to the rear end. When the cartridge shutter Kk4 of the toner cartridge Kk is inserted at a rotation position which does not correspond to the shutter passage groove 6, the toner cartridge Kk interferes with the front end surface of the holder base 2 and cannot be inserted to the rear end.

In a state where the toner cartridge Kk is mounted to the read end, if the user rotates a cartridge handle Kk6 which is an example of an operating portion and is provided at the front end of the toner cartridge Kk, the cartridge shutter Kk4 is caught on the shutter holding portion 8 so as not to be rotated, the container main body Kk1 and the outlet port portion Kk2 are rotated, and the main body-side shutter 12 is moved while being held by the outlet port portion Kk2. Therefore, the outlet port Kk3 is opened and the inlet port 9 is also opened, so as indicated by the outlet port opening position in FIG. 3B, the outlet port Kk3 and the inlet port 9 are connected to each other, such that the developer can be supplied.

A push-in rib Kk7 which is an example of a push-in transmission portion and projects in the circumferential direction of the container main body Kk1 is formed at the front end portion of the toner cartridge Kk of the first embodiment.

Figures 8A, 8B:
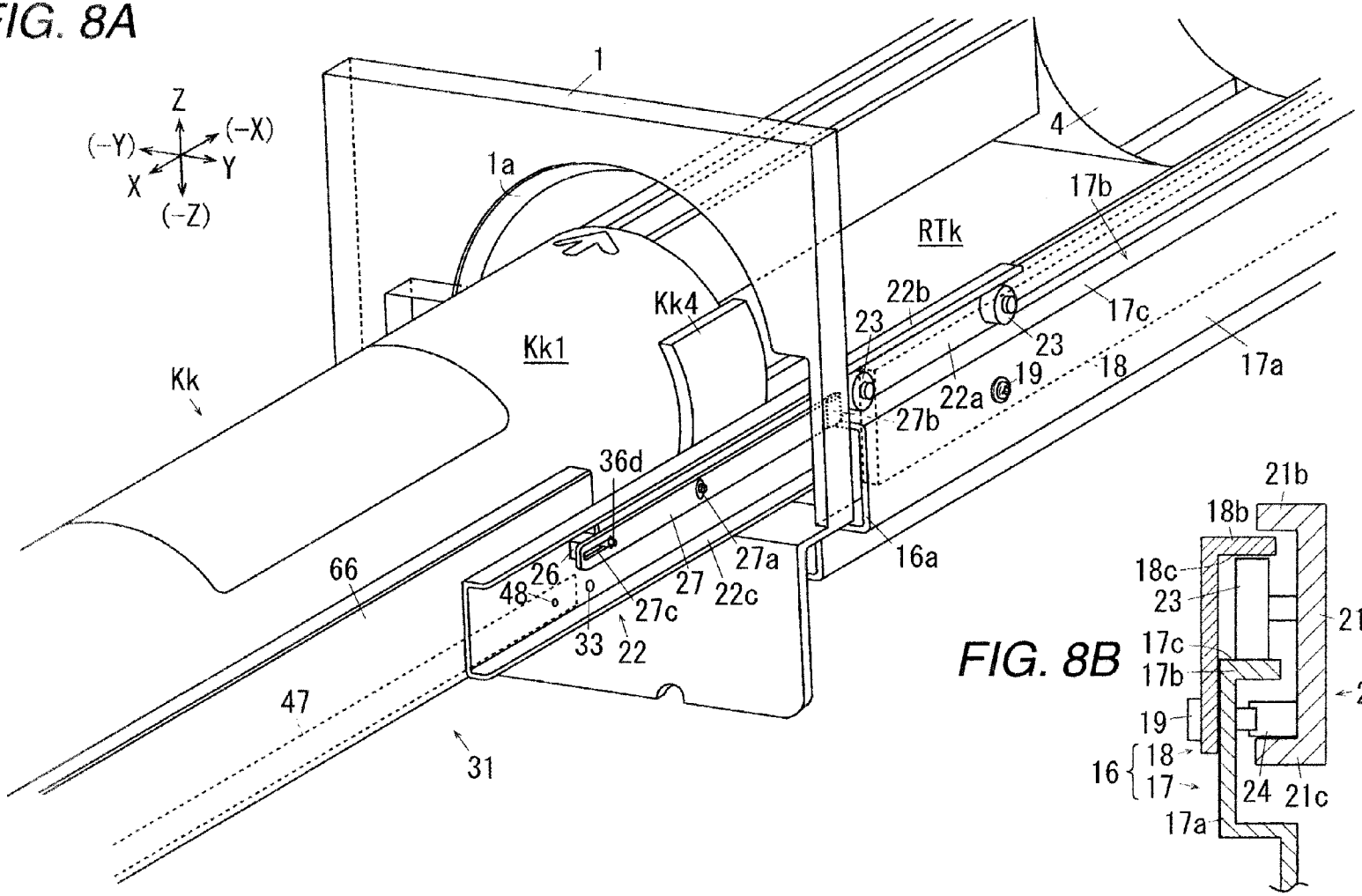
FIGS. 8A and 8B are explanatory views of the main portions of a pull-out member according to the first exemplary embodiment, specifically.

FIGS. 8A and 8B are explanatory views of the main portions of a pull-out member according to the first embodiment, specifically, FIG. 8A is an explanatory view when viewed from the direction of the arrow VIII in FIG. 4, and FIG. 8B is a sectional view taken along the line VIIIB-VIIIB in FIG. 6.

Figure 9:
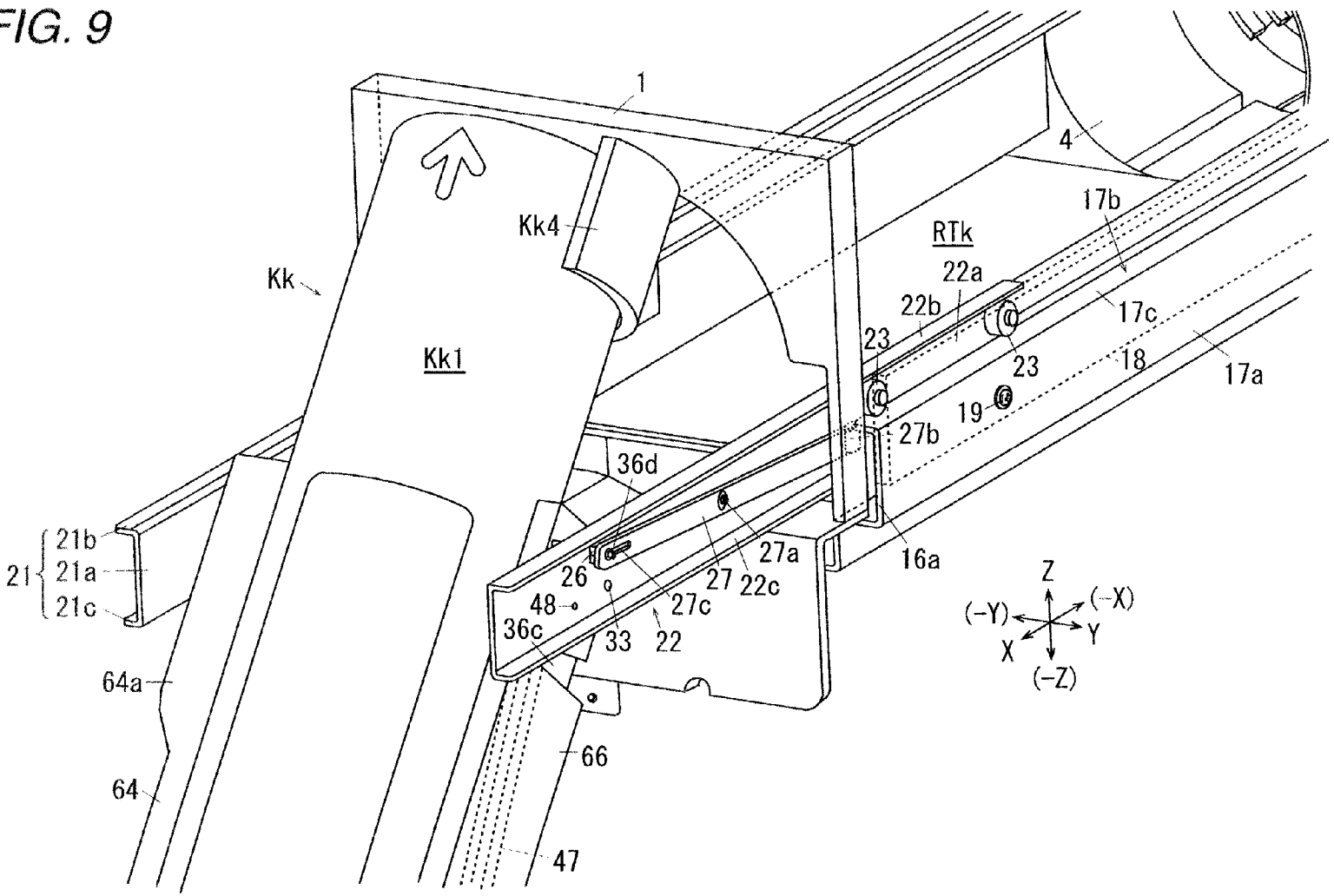
FIG. 9 is an explanatory view of the main portions when viewed from the direction of the arrow IX in FIG. 5.

FIG. 9 is an explanatory view of the main portions when viewed from the direction of the arrow IX in FIG. 5.

In FIGS. 8A, 8B, and 9, and the subsequent drawings, for easy description of the apparatus and understanding, the members which are disposed inside and not viewed from the outside are indicated by solid lines, and the members which are disposed outside are indicated by broken lines or chain lines, or omitted.

Referring to FIGS. 3A to 7, on the left and right sides of the holder base 2, a pair of left and right guide rails 16 which are an example of a pull-out guide member and extend in the front-back direction are fixedly supported. Referring to FIGS. 8A and 9, the guide rails 16 have a rail main body 17 which is an example of a guide portion main body and is disposed on the lower side in the direction of gravity. The rail main body 17 has a side wall portion 17*a* which extends in the up-down direction, and a lower-side guide portion 17*b* which is formed so as to be bent from the upper end of the side wall portion 17*a* inward. At the upper surface of the lower-side guide portion 17*b*, a lower-side roller guide surface 17*c* is formed. At the outer side surface of the rail main body 17, an upper-side guide rail 18 which is an example of an upper-side guide member and extends upward is fixedly supported by a screw 19. The upper-side guide rail 18 has an outer-side cover portion 18*a* which is an example of a closing portion and extends upward, and an upper-side guide portion 18*b* which is bent from the upper end of the outer-side cover portion 18*a* inward. An upper roller guide surface 18*c* is formed at the lower surface of the upper-side guide portion 18*b*.

Inside the pair of left and right guide rails 16, a pair of left and right guided rails 21 and 22 which are an example of a pull-out member are supported so as to be movable in the front-back direction. Referring to FIGS. 3A to 3C, 8A, and 9, the guided rails 21 and 22 have pull-out member main bodies 21*a* and 22*a* which extend in the up-down direction, and upper-side guided portions 21*b* and 22*b* and lower-side guided portions 21*c* and 22*c* which are bent from the upper and lower ends of the pull-out member main bodies 21*a* and 22*a* outward, respectively. The upper-side guided portions 21*b* and 22*b* are disposed such that the lower surfaces thereof are opposite the upper surface of the upper-side guide portion 18*b*, and the guided rails 21 and 22 are supported so as to be movable in the front direction which is the pull-out direction and in the rear direction which is the push-in direction.

At the rear portions of the pull-out member main bodies 21*a* and 22*a*, rollers 23 which are examples of a pair of front and rear guided members are rotatably supported, and the rollers 23 are disposed while being sandwiched between the lower-side roller guide surface 17*c* and the upper-side roller guide surface 18*c* of the guide rails 16. Thus, when the guided rails 21 and 22 are moved, the rollers 23 are rotated on the roller guide surfaces 17*c* and 18*c*, so frictional resistance is small, as compared with a case where no rollers 23 are provided, and even a weak force ensures smooth movement in the front-back direction.

Referring to FIGS. 3A to 3C, at the rear portions of the pull-out member main bodies 21*a* and 22*a*, stoppers 24, which are an example of a pull-out stopped portion and project outward, that is, toward the side wall portions 17*a* of the guide rails 16, are formed. FIGS. 3A to 3C show only the stopper 24 of the left-side guided rail 21. Referring to FIG. 8B, the stopper 24 is disposed so as to be in contact with and separated from the inner end of the screw 19, which is an example of a pull-out stop portion, and secures and passes through the rail main body 17 and the upper guide rail 18. Thus, if the guided rails 21 and 22 are pulled out forward and then pulled out to the pull-out position shown in FIG. 4, the stopper 24 and the screw 19 come into contact with each other, and further forward movement of the guided rails 21 and 22 is regulated. Therefore, the guided rails 21 and 22 of the first embodiment are supported so as to be movable between the accommodation position shown in FIGS. 3A to 3C and the pull-out position shown in FIG. 4.

Referring to FIGS. 8A to 9, a through hole 26 is formed at the front end portion of the pull-out member main body 22*a* of the right-side guided rail 22 to pass through the pull-out member main body 22*a* in the left-right direction.

A link 27 which is an example of an interlocking member and extends in the front-back direction is supported by the right-side guided rail 22 so as to be rotatable around a link rotation center 27*a* along the outer surface at the back of the through hole 26. At the rear end of the link 27, a stopped portion 27*b* is bent in a J shape so as to come into contact with and be separated from the erroneous insertion stop portion 16*a* at the front end of the right-side guide rail 16. Thus, the link 27 is supported so as to be rotatable around the link rotation center 27*a* between a stop portion separation position shown in FIGS. 8A and 8B where the stopped portion 27*b* is separated from the erroneous insertion stop portion 16*a* and the guided rail 22 is movable between the accommodation position and the pull-out position, and a stop position contact position shown in FIG. 9 where the stopped portion 27*b* comes into contact with the erroneous insertion stop portion

16*a* and the movement of the guided rail 22 from the pull-out position to the accommodation position is regulated.

At the front end of the link 27, a long hole-shaped connection hole 27*c* is formed to correspond to the through hole 26 and to extend in the front-back direction.

Figure 10:
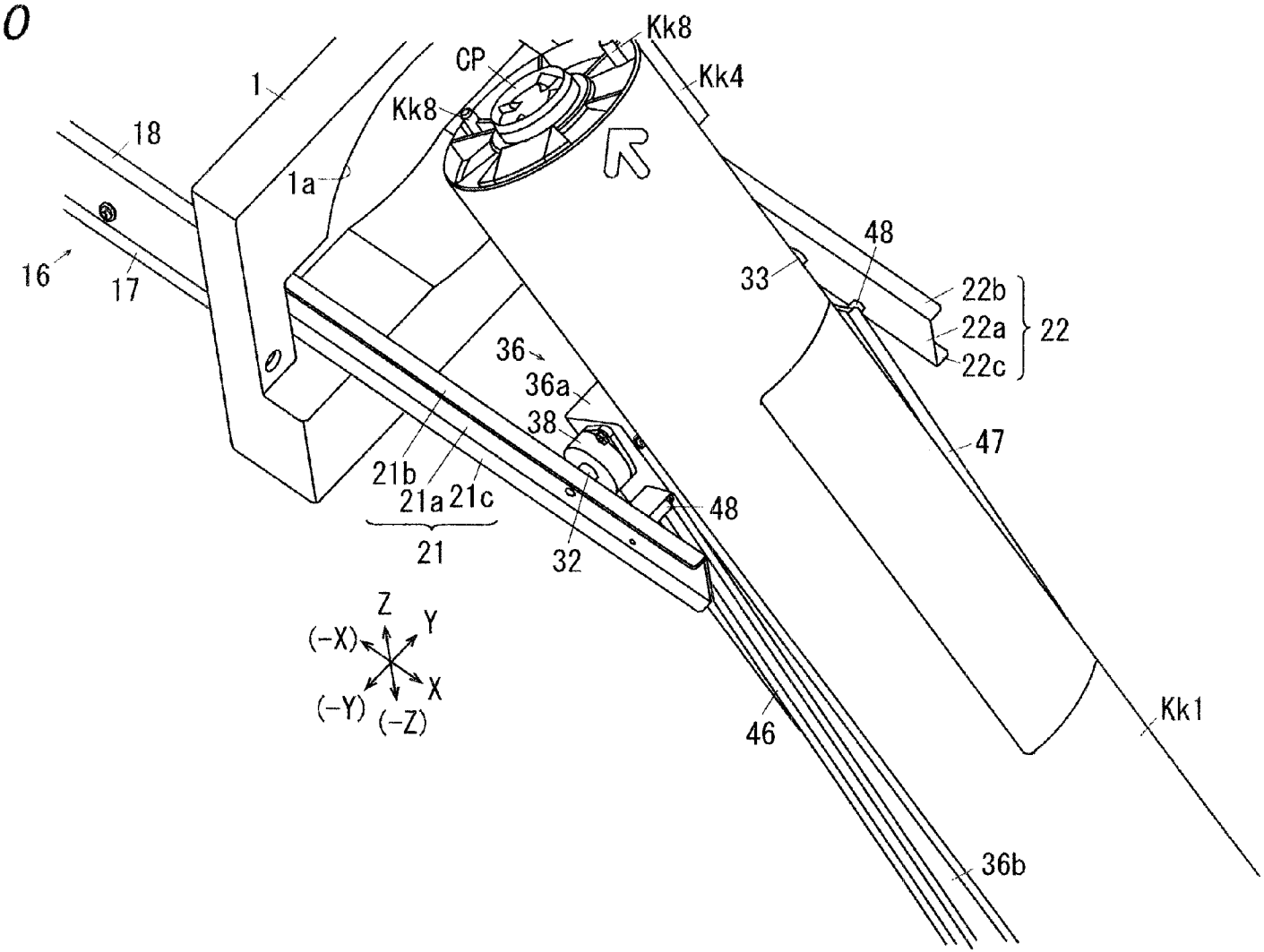
FIG. 10 is an explanatory view of a regulating member according to the first exemplary embodiment.

FIG. 10 is an explanatory view of a regulating member of the first embodiment.

In FIG. 10, for easy understanding of a holder frame, a holder cover is not shown.

Referring to FIGS. 3A to 9, at the front end portions of the guided rails 21 and 22, an inclined holder 31 which is an example of a holder or an example of a rotatable holder is supported so as to be rotatable around the holder rotation shafts 32 and 33. The inclined holder 31 has a holder frame 36 which is an example of a frame body. Referring to FIG. 10, the holder frame 36 has a plate-shaped holder frame bottom wall 36*a* which extends along the axial direction of the toner cartridge Kk, and a holder frame left-side wall 36*b* and a holder frame right-side wall 36*c* which extend upward from the left and right ends of the holder frame bottom wall 36*a*. The holder rotation shafts 32 and 33 are connected to the rear end portions of the holder frame left-side wall 36*b* and the holder frame right-side wall 36*c*, respectively.

Referring to FIGS. 8A, 8B and 9, a link connection pin 36*d* which is an example of a connector and extends rightward is supported by the holder frame right-side wall 36*c* at a position away rearward from the right-side holder rotation shaft 33. The link connection pin 36*d* passes through the through hole 26 of the guided rail 22 and is connected to the connection hole 27*c* of the link 27. The connection hole 27*c* of the first embodiment is formed in a long hole shape, link connection pin 36*d* is connected so as to be movable along the connection hole 27*c*. As shown in FIGS. 8A, 8B, and 9, the link connection pin 36*d* is disposed at a position in the vicinity of the holder rotation shaft 33.

Thus, if the inclined holder 31 is rotated around the holder rotation shafts 32 and 33 the link 27 which is connected to the inclined holder 31 by the link connection pin 36*d* is interlocked and rotationally moved between the stop portion separation position shown in FIGS. 8A and 8B and the stop portion contact position shown in FIG. 9.

In FIG. 10, a one-way hinge 38 which is an example of a regulating member or an example of an overload protection device is fitted into the left-side holder rotation shaft 32. The one-way hinge 38 is a commercially available device which has a function as an Overload protection device or a so-called torque limiter for interrupting the transmission of a rotational force when a rotational force is applied which is equal to or larger than a predetermined rotational force, and also has a function as a one-way rotation interruption device or a one-way clutch for transmitting only one-way rotation and idling rotation in other ways. The one-way hinge 38 of the first embodiment interrupts the transmission of the rotational force when a rotational force which is applied to a specific rotation direction around the holder rotation shaft 32 is equal to or larger than the predetermined rotational force, and transmits the rotational force without interrupting the transmission of the rotational force, when a rotational force is applied in a direction opposite to the specific rotation direction. That is, when a rotation force in an inclined rotation direction, which is the rotation direction from the insertion possible position shown in FIG. 4 toward an inclined position shown in FIG. 5, which is as an example of an attachment/detachment position, is equal to or larger than the predetermined rotational force, the transmission of the rotational force is interrupted, and the movement speed in the rotational movement to the inclined position is lessened. Meanwhile, a rotational force is transmitted in a reverting rotation direction, which is the rotation direction from the inclined position toward the insertion possible position. In the first embodiment, the predetermined rotational force is set to be a value smaller than the natural rotational force for rotating the inclined holder 31 due to gravity.

Figure 11B:
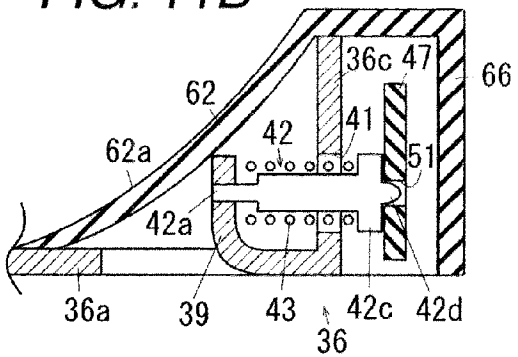
FIGS. 11A and 11B are explanatory views of the main portions of an inclined holder according to the first exemplary embodiment, specifically.
Figure 11A:
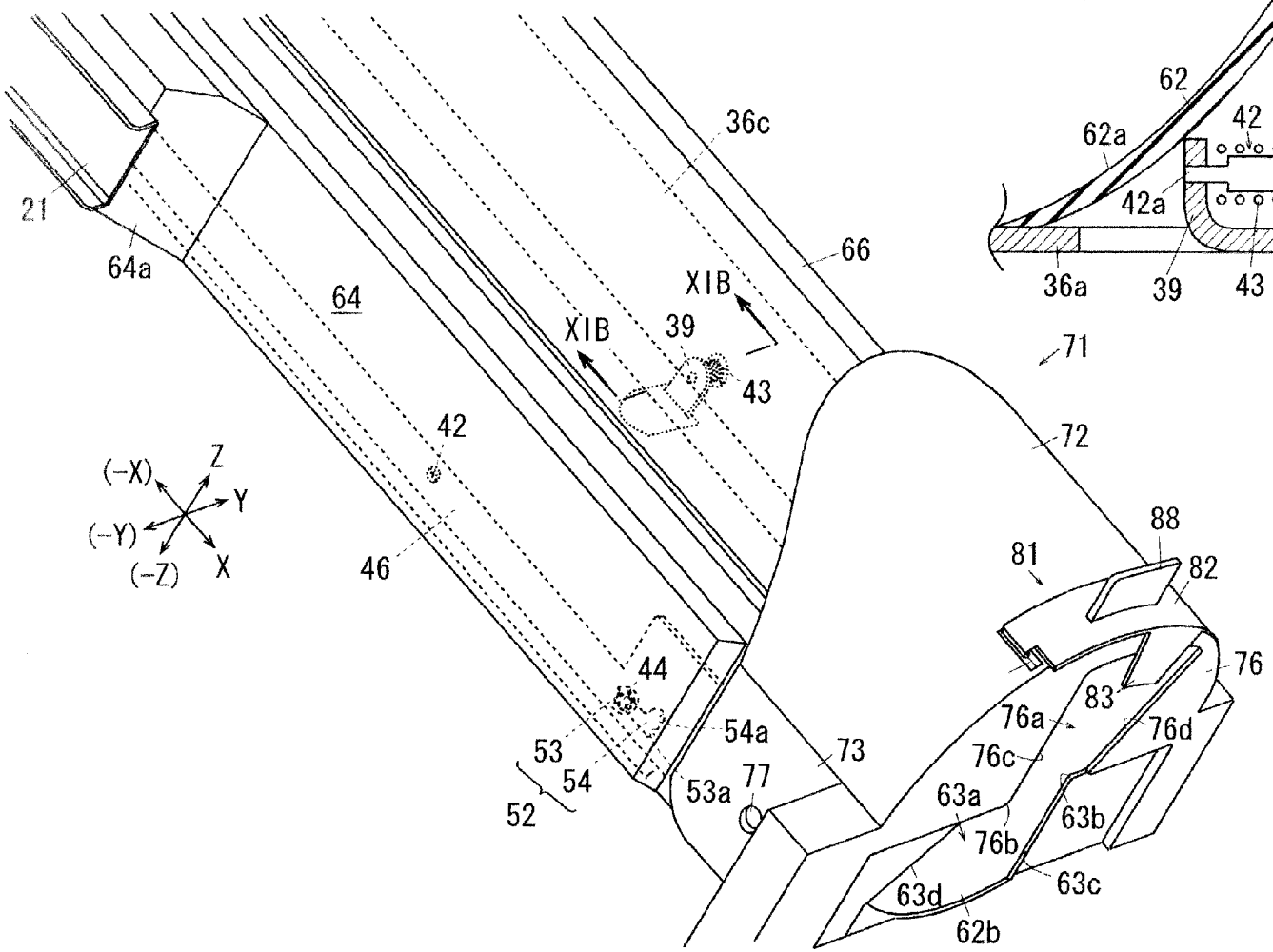

FIGS. 11A and 11B are explanatory views of the main portions of an inclined holder according to the first embodiment, specifically, FIG. 11A is an explanatory view of the main portions of a front portion of the inclined holder when being moved to an insertion possible position in FIG. 4, and FIG. 11B is a sectional view taken along the line XIB-XIB in FIG. 11A.

Figure 12:
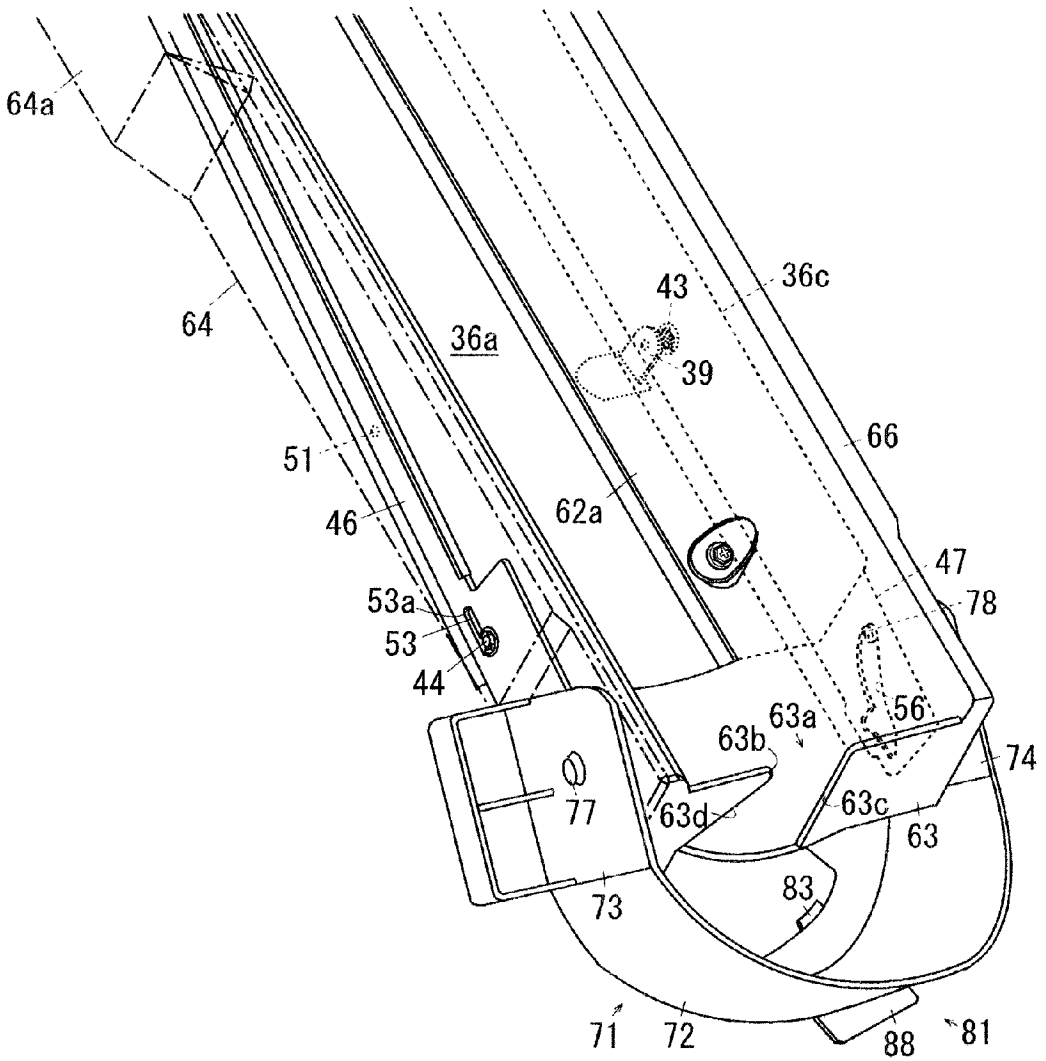
FIG. 12 is an explanatory view of the main portions of the inclined holder according to the first exemplary embodiment, and an explanatory view of the front portion of the inclined holder when being moved to the inclined position in FIG. 7.

FIG. 12 is an explanatory view of the main portions of the inclined holder according to the first embodiment, and an explanatory view of the front portion of the inclined holder when being moved to the inclined position in FIG. 7.

Referring to FIG. 11A, 11B, and FIG. 12, a pair of left and right cut-and-raised portions 39 are formed to have a cut-and-raised shape at the holder frame bottom wall 36*a* of the front portion of the holder frame 36. In FIGS. 11A, 11B, and 12, only the right-side cut-and-raised portion 39 is shown.

Referring to FIGS. 11A, 11B, and 12, at the holder frame side walls 36*b* and 36*c*, pin passage ports 41, which are an example of a locking passage port to pass through the holder frame side walls 36*b* and 36*c* in the left-right direction, are formed at the positions opposite the cut-and-raised portions 39. Pins 42 which are an example of a lock members and pass through the pin passage ports 41 and project outward of the holder frame side walls 36*b* and 36*c*, respectively, are supported by the cut-and-raised portions 39 so as to be movable in the left-right direction.

Referring to FIG. 11B, the pin 42 has a supported portion 42*a* which is supported so as to be movable in the left-right direction while passing through a support hole 39*a* of the cut-and-raised portion 39. Outside the supported portion 42*a*, a pin main body 42*b*, which passes through the pin passage port 41 and has a diameter larger than that of the supported portion 42*a*, is formed integrally with the supported portion 42*a*. At the outer end portion of the pin main body 42*b*, a disc-shaped spring support portion 42*c* is formed integrally with the pin main body 42*b* so as to have a diameter larger than that of the pin main body 42*b*. At the spring support portion 42*c*, a projection-shaped locking portion 42*d* is formed to project outward from the spring support portion 42*c*.

Referring to FIGS. 11A, 11B, and 12, a pin urging springs 43 which is an example of an urging member and urges the spring support portion 42*c* outward is mounted between the cut-and-raised portion 39 and the spring support portion 42*c*.

Ahead of the cut-and-raised portions 39 of the holder frame side walls 36*b* and 36*c*, a pair of left and right support connection studs 44 which are an example of a rotation regulating portion are supported to extend outward from the holder frame side walls 36*b* and 36*c*.

Figure 13:
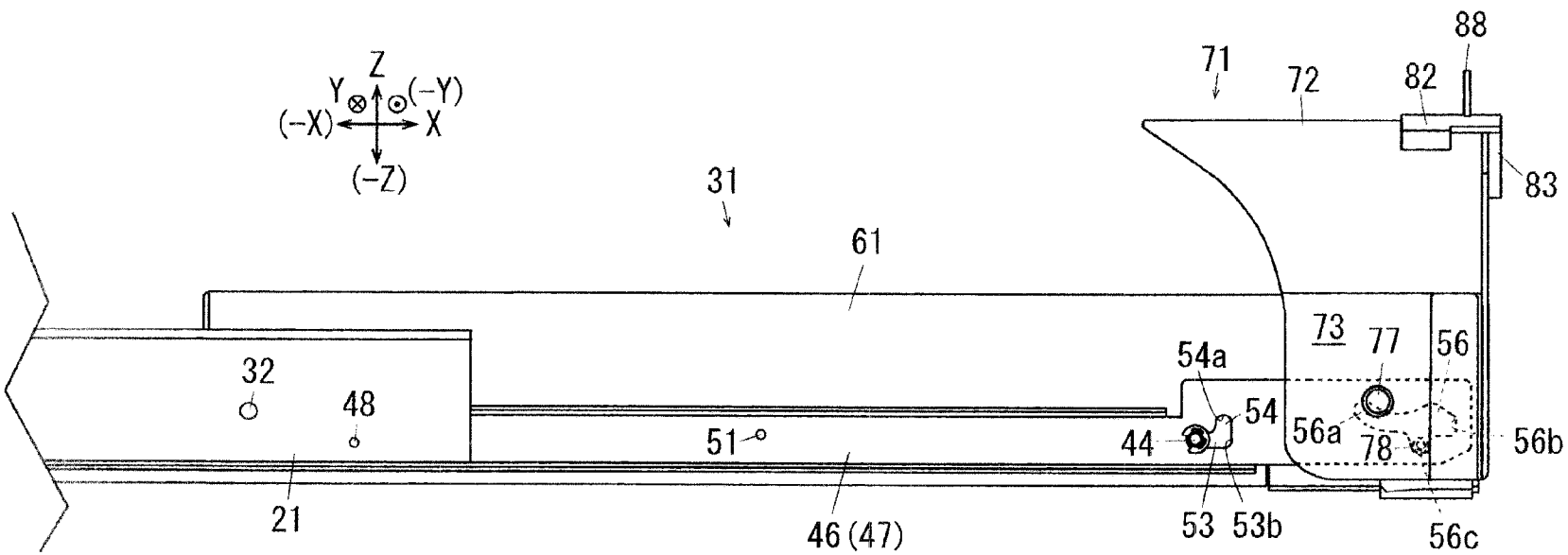
FIG. 13 is an explanatory view of the main portions of a support when guided rails are moved to the pull-out position and the inclined holder is held at the insertion possible position.

FIG. 13 is an explanatory view of the main portions of a support when guided rails are moved to the pull-out position and the inclined holder is held at the insertion possible position.

Figure 14:
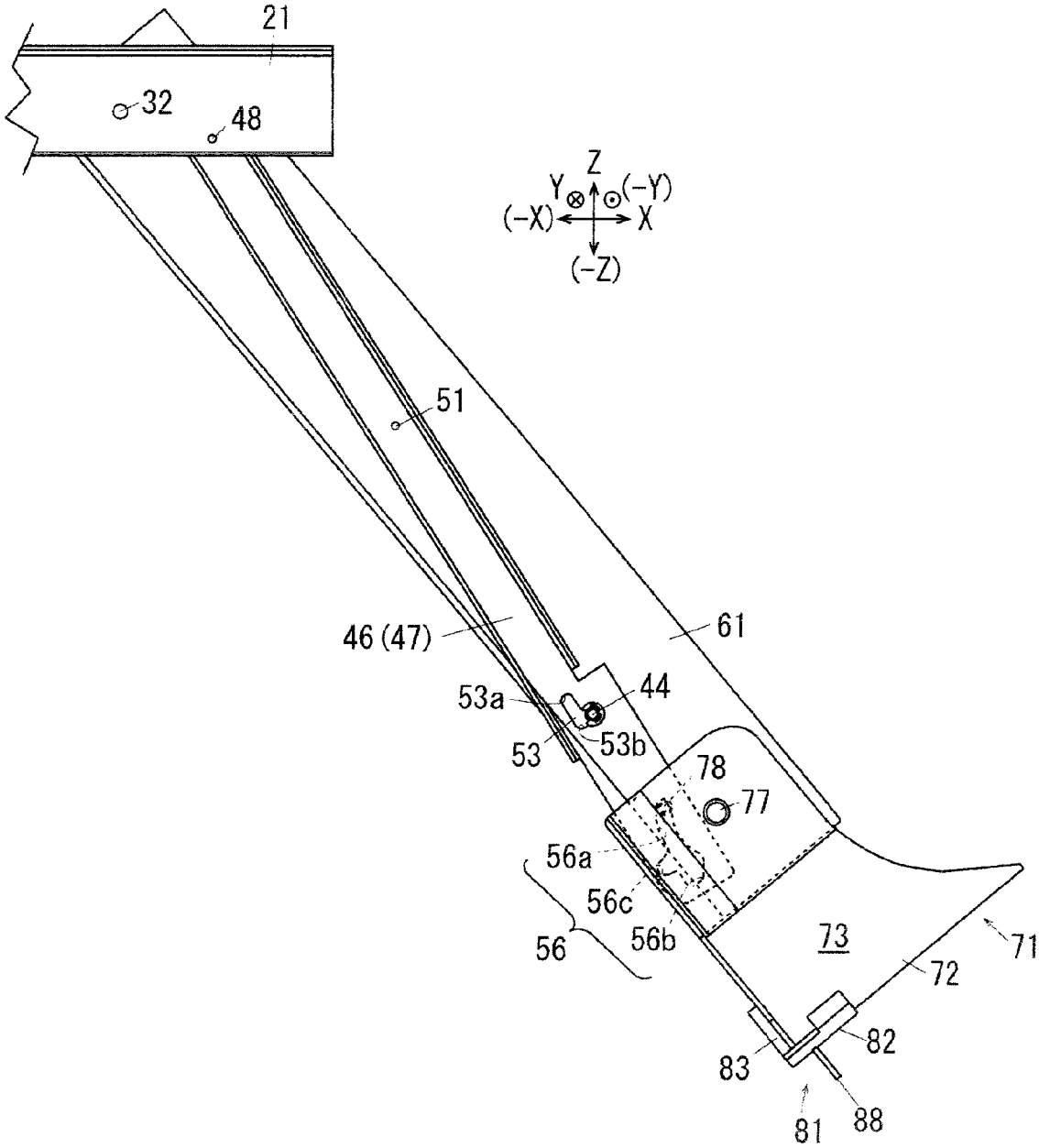
FIG. 14 is an explanatory view of the main portions of a support when the inclined holder is moved to the inclined position and the front end cover is moved to the opening position from the state in FIG. 13.

FIG. 14 is an explanatory view of the main portions of a support when the inclined holder is moved to the inclined position and the front end cover is moved to the opening position from the state in FIG. 13.

Referring to FIGS. 8A to 14, outside the holder frame side walls 36*b* and 36C of the holder frame 36, plate-shaped left-side support 46 and right-side support 47 which are an example of an auxiliary rotator are disposed to extend in the front-back direction. The rear end portions of the supports 46 and 47 are rotatable supported by the guided rails 21 and 22 through support rotation shafts 48, which are an example of an auxiliary rotation shaft and disposed at positions on the front sides of the holder rotation shafts 32 and 33. As shown in FIGS. 8A to 10, the support rotation shafts 48 of the first embodiment are disposed at the positions in the vicinity of, that is, close to the front sides of the holder rotation shafts 32 and 33.

Referring to FIGS. 8A to 14, at the central portion in the front-back direction of each of the supports 46 and 47, a latch hole 51 which is an example of a locked portion is formed to correspond to the locking portion 42*d* in a state where the inclined holder 31 is moved to the insertion possible position shown in FIG. 13. That is, in a state where the inclined holder 31 is moved to the insertion possible position shown in FIG. 13, as shown in FIG. 11B, the latch hole 51 is held so as to be locked to, that is, engaged with the locking portion 42*d* by an elastic force of the pin urging spring 43. In a state where the inclined holder 31 is moved to the inclined position shown in FIG. 14, the holder rotation shafts 32 and 33 of the holder frame 36 and the support rotation shafts 48 are misaligned, and the locking portion 42*d* and the latch hole 51 are misaligned. For this reason, the locking portion 42*d* is moved inward against the elastic force of the pin urging spring 43 and separated from, that is, disengaged from the latch hole 51.

Referring to FIGS. 11A to 14, at the front portion of each of the supports 46 and 47, an inclined stop groove 52 is formed to correspond to the support connection stud 44. Referring to FIGS. 11A, 11B, and 13, the inclined stop groove 52 has a guide groove portion 53 which extends along a corresponding one of the supports 46 and 47, and a rotation regulating groove portion 54 which extends upward from the front end of the guide groove portion 53. The inclined stop groove 52 is a groove which is formed in a substantially L shape to such a width that the support connection stud 44 is movable along the groove. Referring to FIGS. 11A to 14, at the rear end of the guide groove portion 53, an upper rotation lock surface 53*a* which is an example of an upper rotation regulating portion is formed. The upper rotations lock surface 53*a* comes into contact with the support connection stud 44 at the insertion possible position shown in FIG. 13 to regulate the rotation of the inclined holder 31 upward from the insertion possible position.

At the front end of the guide groove portion 53, a lower rotation lock surface 53*b* which is an example of a lower rotation regulating portion is formed. The lower rotation lock surface 53*b* comes into contact with the support connection stud 44 at the inclined position shown in FIG. 14 to regulate the downward rotation of the inclined holder 31 from the inclined position. That is, the rotation position of the inclined holder 31 where the support connection stud 44 and the lower rotation lock surface 53*b* come into contact with each other is set as the inclined position. The inclined holder 31 is held at the inclined position by the contact of the support connection stud 44 with the lower rotation lock surface 53*b*.

The inner circumferential surface of the rotation regulating groove portion 54 away upward from the lower rotation lock surface 53*b* forms a rotation lock surface 54*a* which is an example of an open rotation regulating portion.

Figure 15:
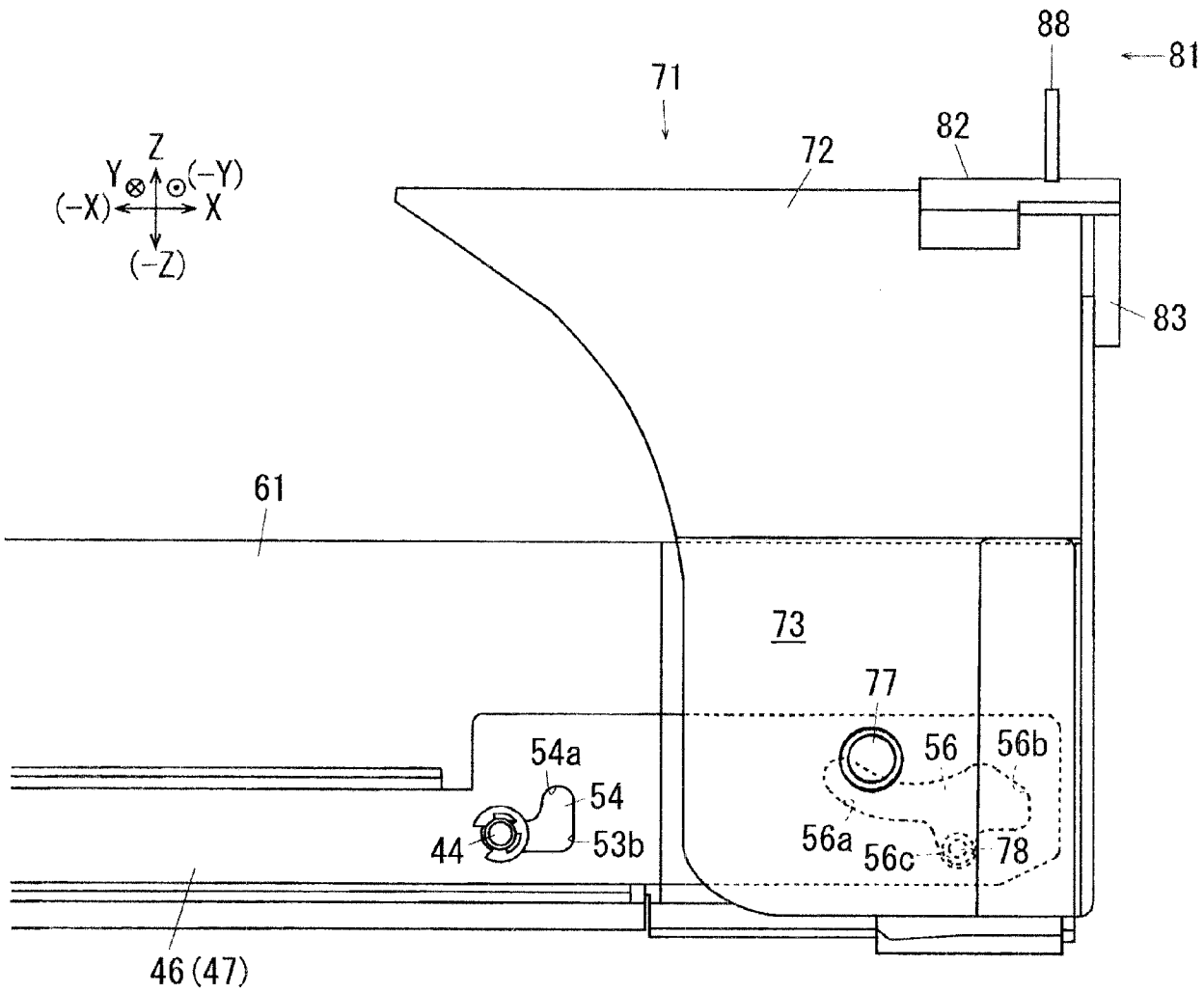
FIG. 15 is an explanatory view of the main portions of a front end portion of the inclined holder according to the first exemplary embodiment, and an explanatory view of a state where the inclined holder is moved to the insertion possible position.

FIG. 15 is an explanatory view of the main portions of a front end portion of the inclined holder according to the first embodiment, and an explanatory view of a state where the inclined holder is moved to the insertion possible position.

Figure 16:
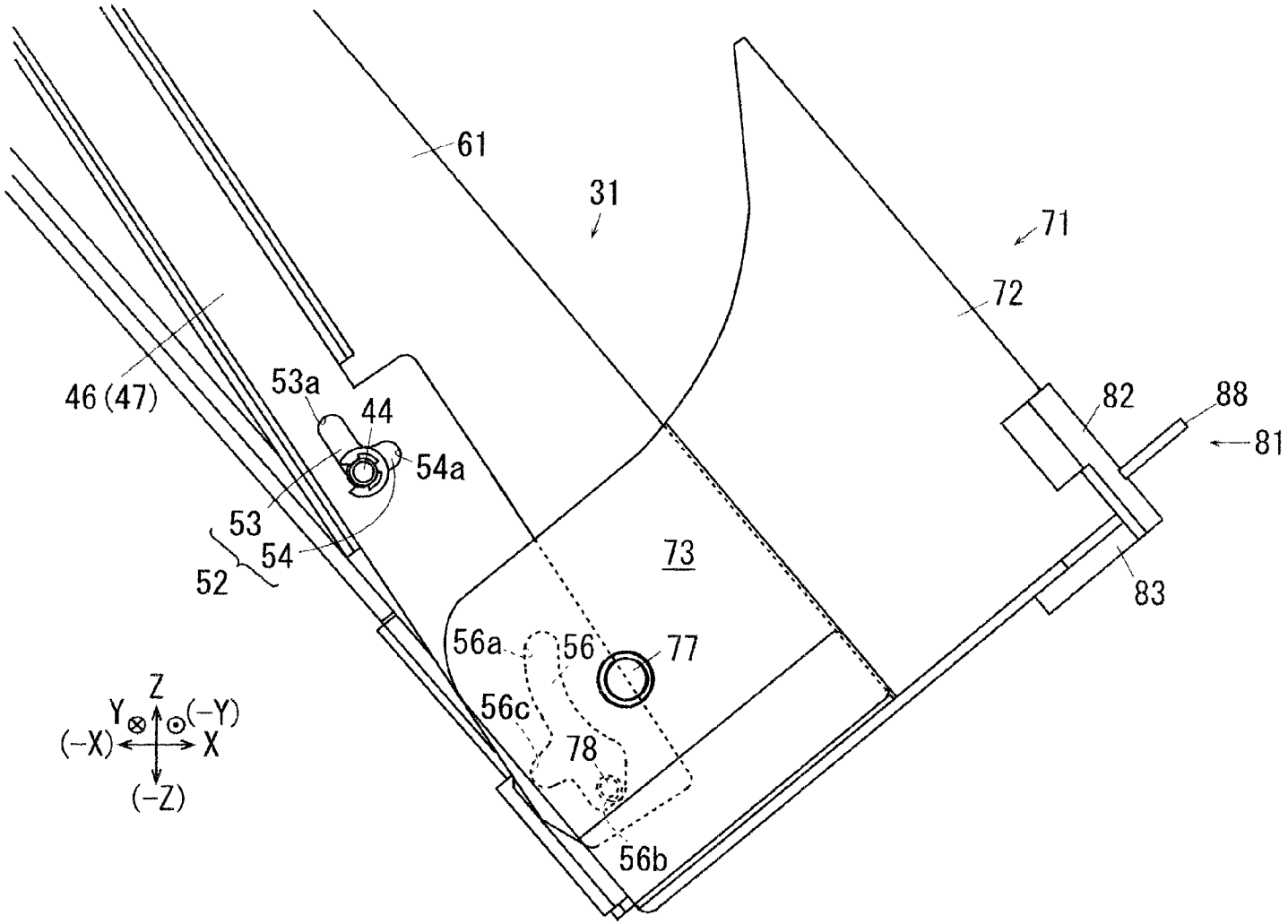
FIG. 16 is an explanatory view of the main portions of the front end portion of the inclined holder according to the first exemplary embodiment, and an explanatory view of a state where the inclined holder is moved to the inclined position.

FIG. 16 is an explanatory view of the main portions of the front end portion of the inclined holder according to the first embodiment, and an explanatory view of a state where the inclined holder is moved to the inclined position.

Figure 17:
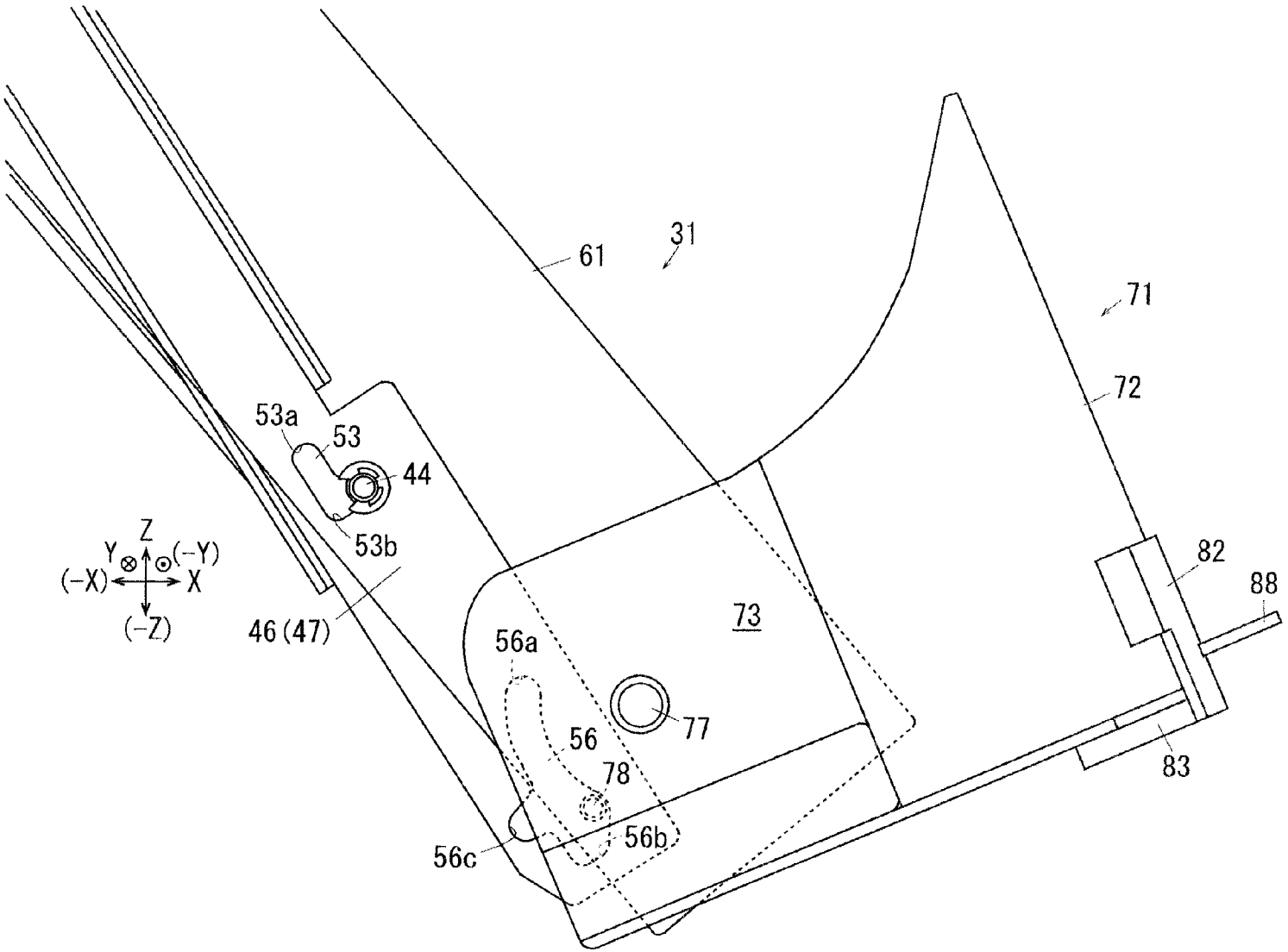
FIG. 17 is an explanatory view of the main portions of the front end portion of the inclined holder according to the first exemplary embodiment, and an explanatory view of a state where the front end cover starts to rotate toward the front end opening position from the state in FIG. 16.

FIG. 17 is an explanatory view of the main portions of the front end portion of the inclined holder according to the first embodiment, and an explanatory view of a state where the front end cover starts to rotate toward the front end opening position from the state in FIG. 16.

Figure 18:
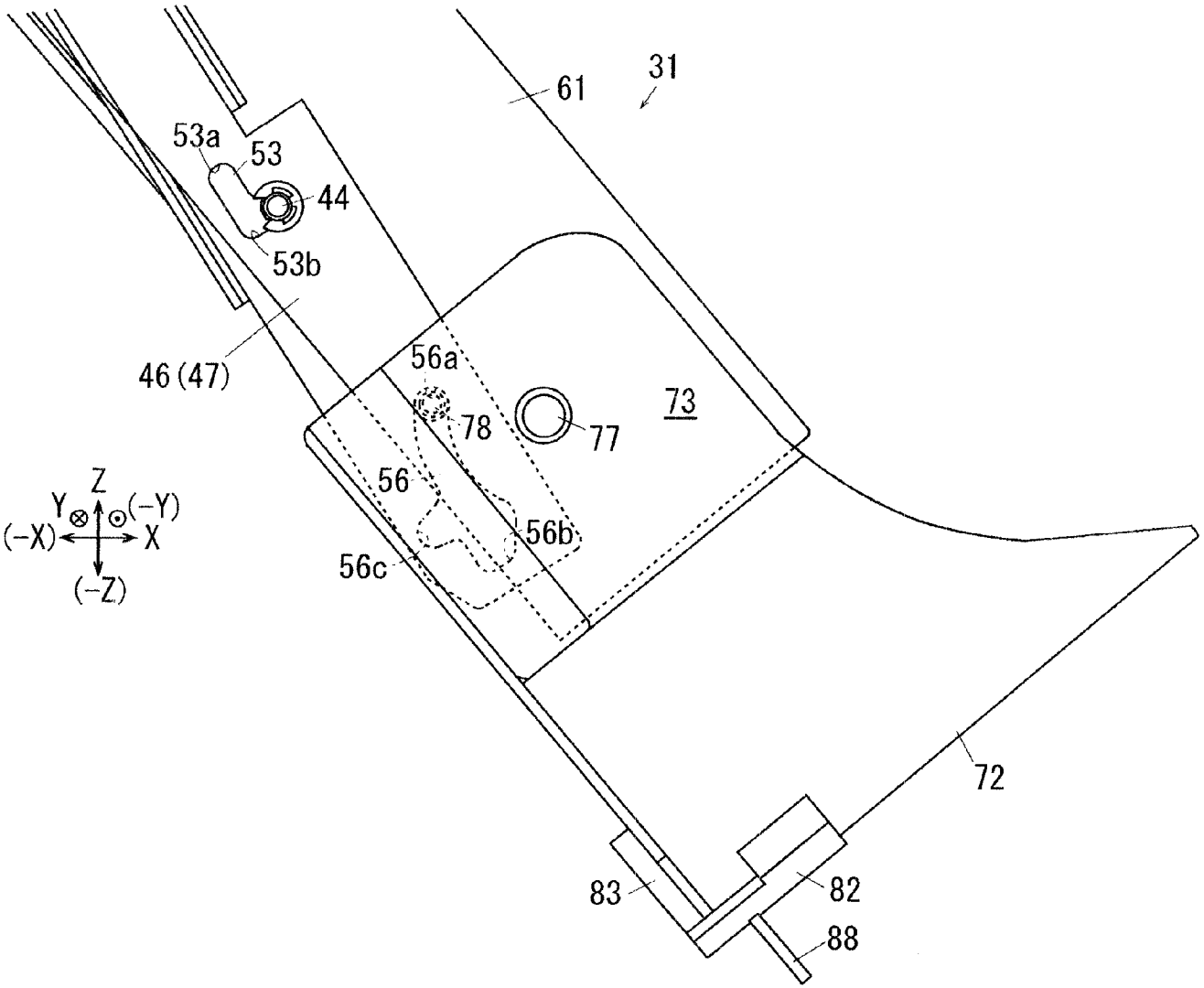
FIG. 18 is an explanatory view of the main portions of the front end portion of the inclined holder according to the first exemplary embodiment, and an explanatory view of a state where the front end cover is moved from the state in FIG. 17 to the front end opening position.

FIG. 18 is an explanatory view of the main portions of the front end portion of the inclined holder according to the first embodiment, and an explanatory view of a state where the front end cover is moved from the state in FIG. 17 to the front end opening position.

Referring to FIGS. 13 to 18, at the front ends of the supports 46 and 47, lock openings 56 which are an example of a rotation interlocked portion are formed to pass through the supports 46 and 47 in the left-right direction.

Referring to FIG. 15, the lock opening 56 has a cover stud guide groove 56*a* which is an example of a guide portion and extends in a convex arc shape downward from the rear end side, a support unlocking portion 56*b* which is an example of a rotation regulation release portion and has an inner surface, which is formed continuously to the front end portion of the cover stud guide groove 56*a*, is inclined downward as going forward, and then extends downward in the direction of gravity, and a cover locking portion 56*c* which is an example of an opening/closing movement regulating portion and is formed integrally with the support unlocking portion 56*b* and recessed downward with respect to the lower surface of the support unlocking portion 56*b*.

Figure 19:
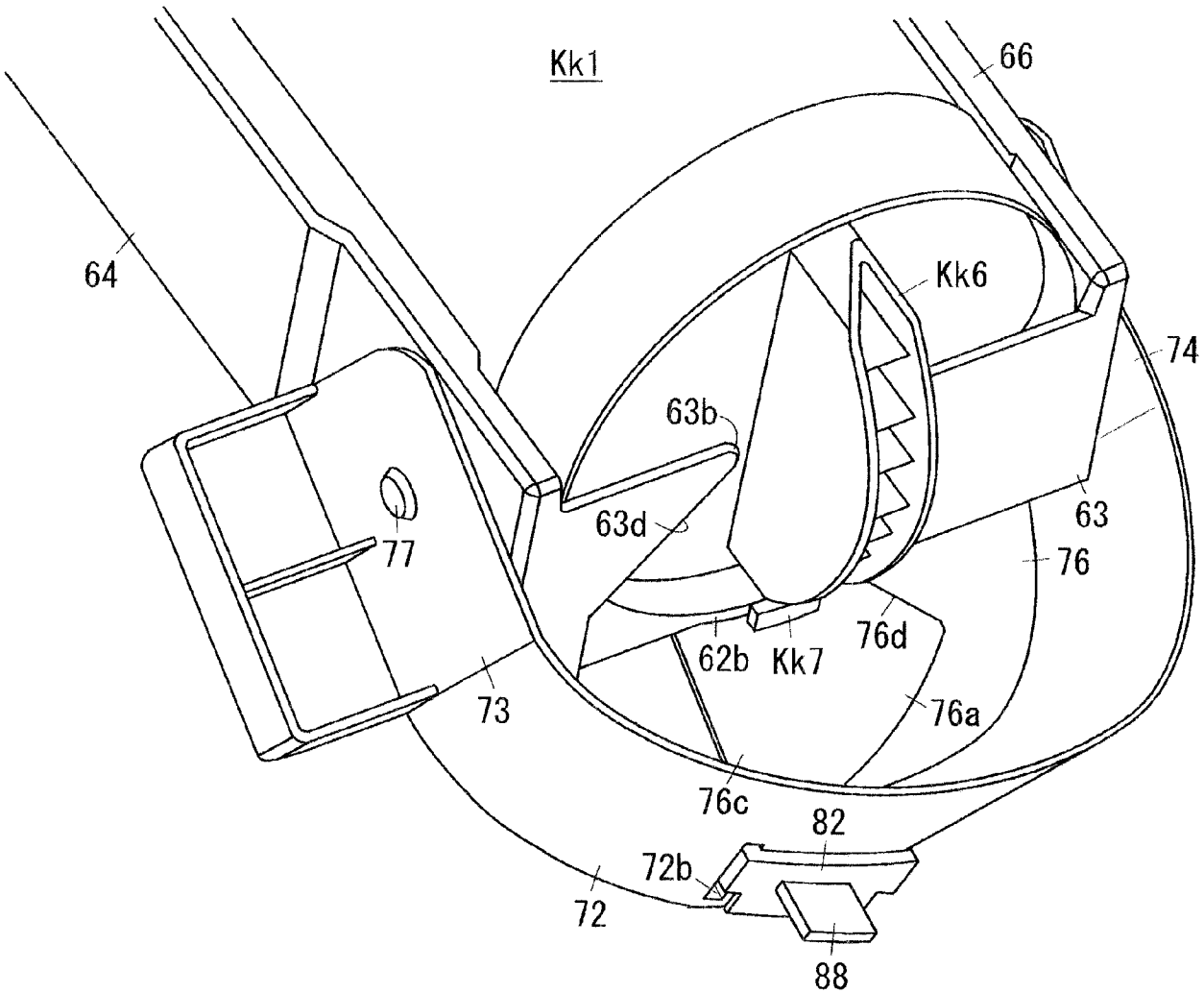
FIG. 19 is an explanatory view of the main portions of the inclined holder and the front end cover according to the first exemplary embodiment, and an explanatory view, corresponding to FIG. 6, of a state where a toner cartridge is mounted.

FIG. 19 is an explanatory view of the main portions of the inclined holder and the front end cover according to the first embodiment, and an explanatory view, corresponding to FIG. 6, of a state where a toner cartridge is mounted.

Referring to FIG. 7 and FIGS. 11A to 14, a holder cover 61 which is an example of a holder covering member is fixedly supported by the holder frame 36. The holder cover 61 has an upper-side cover 62 which is an example of an upper-side covering portion and is disposed on the front side and the left and right sides of the bottom wall 36*a* of the holder frame 36. The upper-side cover 62 has a cartridge holding surface 62*a* which is an example of a removable member holding surface, that is, a semicylindrical upper surface. Referring to FIGS. 12 and 19, at the front end of the upper-side cover 62, a rib contact portion 62*b* which is an example of a push-in transmitted portion is formed. The push-in rib Kk7 can come into contact with the rib contact portion 62*b*.

Referring to FIG. 19., a front end wall 63 is formed integrally at the front end of the upper-side cover 62. In FIG. 12, at the central portion of the front end wall 63, a fan-shaped holder-side handle rotation port 63*a* which is an example of a removable member position regulating portion or an example of an operating portion passage port is formed in a cutout shape. The holder-side handle rotation port 63*a* has a handle passage port 6*b* through which the handle Kk6 of the toner cartridge Kk passes during the attachment/detachment of the toner cartridge Kk. A holder-side attachment/detachment regulating surface 63*c* is formed at the right end of the handle passage port 63*b* to extend downward, and a holder-side rotation regulating portion 63*d* is formed at the left end of the handle passage port 63*b* to be inclined leftward as going downward.

At the upper left edge of the upper-side cover 62, a left cover 64 which covers the outer sides of the left-side wall 36*b* and the left-side support 46 is formed integrally with the upper-side cover 62. At the rear end portion of the left cover 64, a rear end protection portion 64*a* is formed to have a width in the left-right direction larger than that of the central portion in the front-back direction so as to prevent the left-side support 46 and the one-way hinge 38 from being exposed to the outside and to fill the gap between the left-side wall 36*b* and the left-side guided rail 21.

A right cover 66 which covers the outer sides of the right-side wall 36*c* and the right-side support 47 is formed integrally with the upper-side cover 62 at the upper right edge of the upper-side cover 62.

The holder frame 36 and the holder cover 61 form a holder main body 36+61 which holds the toner cartridge Kk.

Figure 20B:
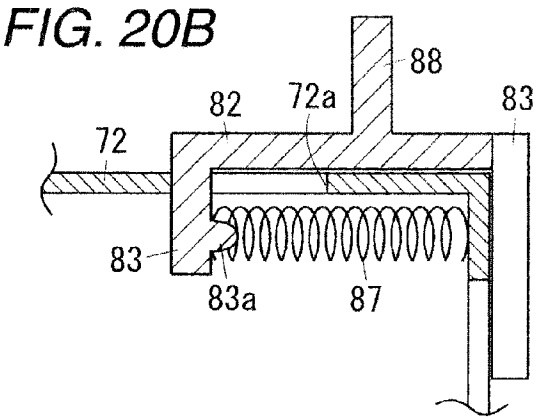
FIGS. 20A to 20C are explanatory views of the main portions when the front cover of the inclined holder of the first exemplary embodiment is moved to a front end closing position, specifically.
Figure 20C:
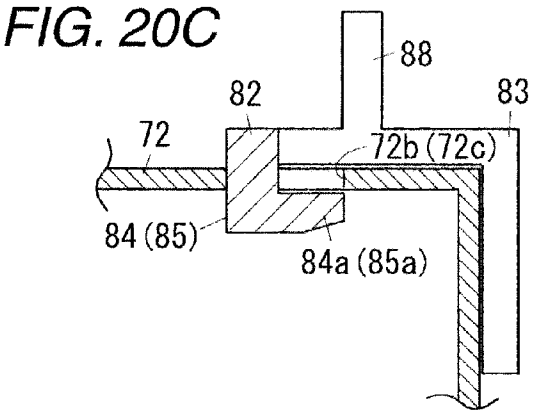
Figure 20A:
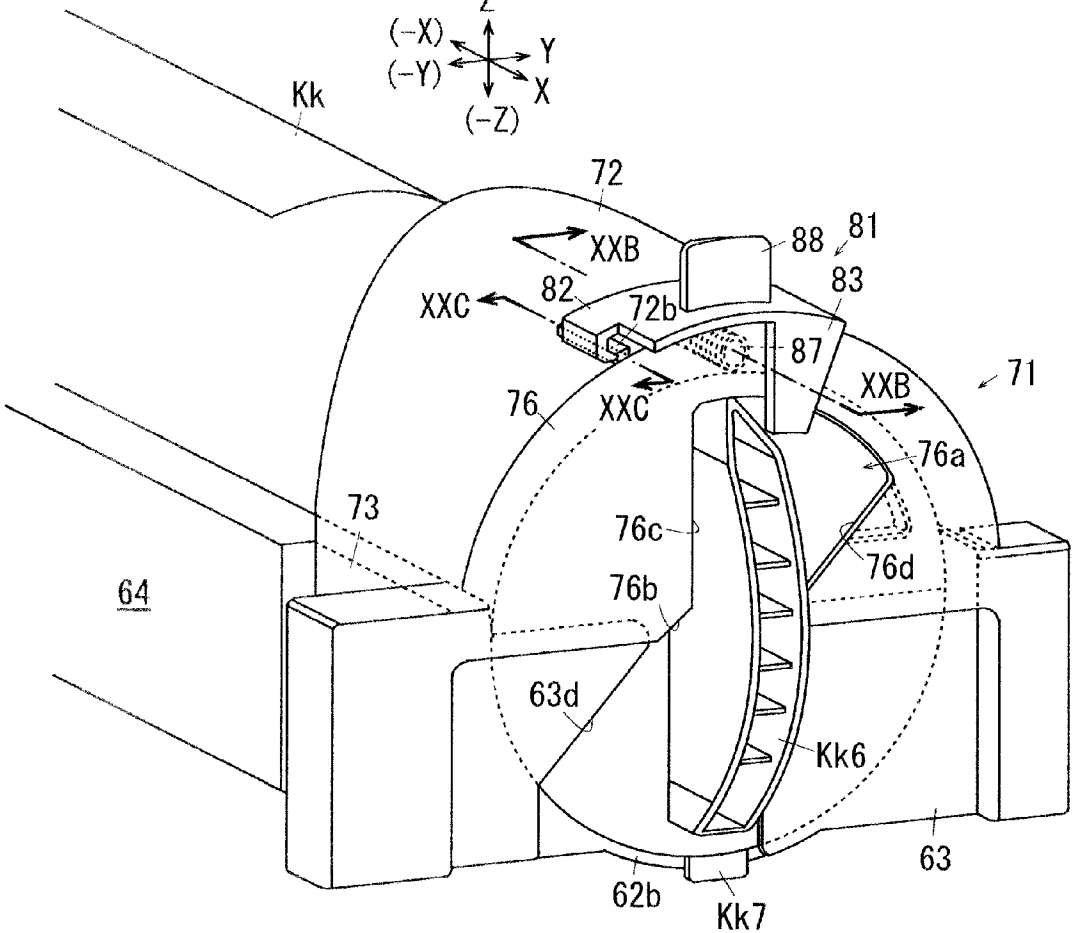

FIGS. 20A to 20C are explanatory views of the main portions when the front cover of the inclined holder of the first embodiment is moved to a front end closing position, specifically, FIG. 20A is a perspective view, FIG. 20B is a sectional view taken along the line XXB-XXB in FIG. 20A, and FIG. 20C is a sectional view taken along the line XXC-XXC in FIG. 20A.

Referring to FIGS. 3A to 7 and FIGS. 11A to 20C, at the front end portion of the holder cover 61, a front cover 71 which is an example of a front end opening/closing member is supported. Referring to FIGS. 15 to 20C, the front cover 71 has a semicylinder-shaped front cover cylindrical wall 72, a front cover left wall 73 and a front cover right wall 74 which extend from the left and right ends of the front cover cylindrical wall 72 along the left cover 64 and the right cover 66 respectively, and a front cover front wall 76 which is formed at the front end of the front cover cylindrical wall 72 to correspond to the front end wall 63.

The front cover left wall 73 and the front cover right wall 74 respectively have cover rotation shafts 77 which extend inward in the left-right direction and are rotatably supported by the left cover 64 and the right cover 66. Thus, the front cover 71 of the first embodiment is supported so as to be rotatable around the cover rotation shafts 77 between the front end closing position shown in FIGS. 6, 7, 11A and 11B, 13, 15, 16, and 20A to 20C and the front end opening position shown in FIGS. 5, 12, 14, 18, and 19.

At the front cover left wall 73 and the front cover right wall 74, lock studs 78, which are an example of a rotation interlocking portion and project inward in the left-right direction, are formed at the downward positions on the front sides of the cover rotations shafts 77 when at the front end closing position shown in FIGS. 13, 15, and the like and the positions corresponding to the lock openings 56 of the supports 46 and 47. The lock stud 78 is fitted into the lock opening 56 and is connected so as to be movable inside the lock opening 56 during the rotation of the front cover 71 or during the rotation of the supports 46 and 47.

Referring to FIGS. 20A to 20C, a cover-side rotation port 76*a* which is an example of a removable member position regulating portion or an example of an operating portion passage port is formed in a fan-like cutout shape at the central portion of the front cover front wall 76. At the front end closing position in FIGS. 20A to 20C, the cover-side handle rotation port 76*a* has a narrow portion 76*b* which is formed opposite to the handle passage port 63*b* and has a width corresponding to the cartridge handle Kk6, a cover-side attachment/detachment surface 76*c* which extends upward from the left end of the narrow portion 76*b*, and a cover-side rotation regulating surface 76*d* which is inclined rightward as going upward from the right end of the narrow portion 76*b*.

Thus, the toner cartridge Kk of the first embodiment is supported so as to be rotatable within a possible rotation range between an attachment/detachment position shows in FIGS. 20A to 20C where the cartridge handle Kk6 comes into contact with the attachment/detachment regulating surfaces 63*c* and 76*c* and a replenishment position shown in FIGS. 3A to 3C where the cartridge handle Kk6 is rotated from the attachment/detachment position and comes into contact with the rotation regulating surfaces 63*d* and 76*d*, such that the developer replenishment is possible.

The front end wall 63 of the holder cover 61 and the front wall 76 of the front cover 71 form a pull-out regulating member 63+76 which regulates the forward movement of the toner cartridge Kk when the inclined holder 31 is inclined, so as to prevent dropping.

Referring to FIGS. 20A and 20B, in a state where the front cover 71 is moved to the front end closing position shown in FIGS. 20A to 20C, at the upper end portion of the front cover cylindrical wall 72, a first slit 72*a*, which is an example of a first guide groove and extends in the front-back direction, is formed. Referring to FIGS. 20A and 20C, at the front cover cylindrical wall 72, a second slit 72*b* and a third slit 72*c* which are examples of a second guide groove and a third guide groove are formed at the positions on the left and right sides of the first slit 72*a* along the circumferential direction.

Referring to FIGS. 20A to 20C, a handle lock 81 which is an example of a rotation stop portion is supported at the upper end portion of the front cover cylindrical wall 72. The handle lock 81 has an arc-shaped plate 82 which extends along the outer circumferential surface of the front cover cylindrical wall 72. A locking portion 83 which is an example of a rotation stop portion and extends downward is formed integrally at the front end of the arc-shaped plate 82. The locking portion 83 is disposed such that the rear end thereof enters the cover-side handle rotation port 76*a* and the cartridge handle Kk6 which is moved to the attachment/detachment position shown in FIGS. 20A to 20C is sandwiched between the locking portion 83 and the cover-side attachment/detachment regulating surface 76*c* in the left-right direction.

At the arc-shaped plate 82, guided portions 83, 84, and 85 are formed at the positions corresponding to the slits 72*a* to 72*c* of the front cover cylindrical wall 72 so as to be fitted into the slits 72*a* to 72*c*, respectively. The guided portions 83, 84, and 85 have a length in the front-back direction shorter than that of the slits 72*a* to 72*c*. A projection 83*a* is formed at the lower end of the first guided portion 83, which is fitted into the first slit 72*a*, to project toward the front cover front wall 76. A lock spring 87 which is an example of an enforcing member is mounted between the projection 83*a* and the front cover front wall 76. Holding portions 84*a* and 85*a* are formed at the lower ends of the second guided portion 84 and the third guided portion 85, which are fitted into the second slit 72*b* and the third slit 72*c*, respectively, to extend toward the front cover front wall 76.

Thus, the handle lock 81 is supported so as to be movable in the front-back direction along the slits 72*a* to 72*c*.

Figure 21:
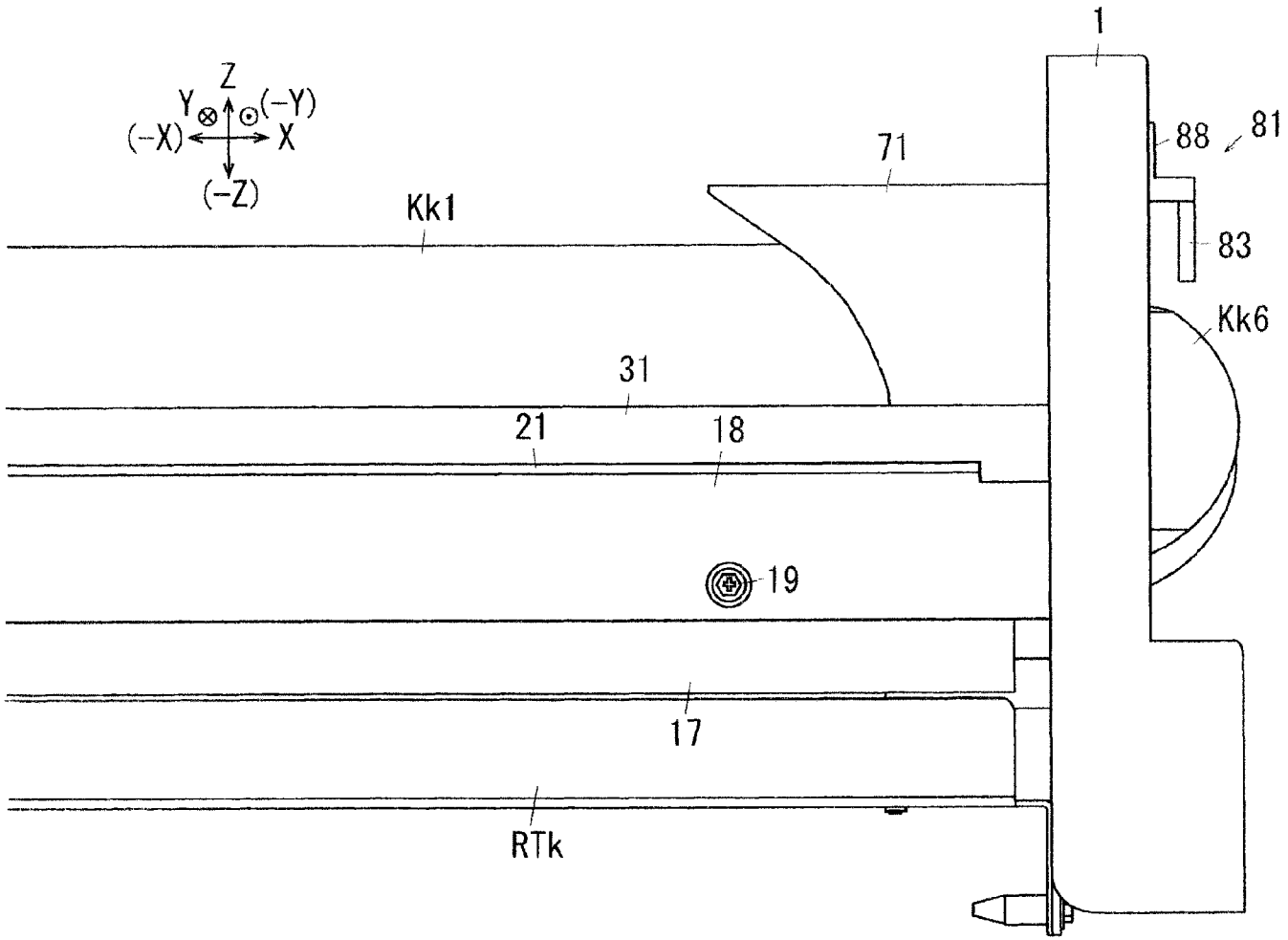
FIG. 21 is an explanatory view of the positional relationship of a handle lock and a front-side frame at the accommodation position shown in FIGS. 3A to 3C.

FIG. 21 is an explanatory view of the positional relationship of a handle lock and a front-side frame at the accommodation position shown in FIGS. 3A to 3C.

Referring to FIGS. 20A to 20C, a contacted portion 88 which is an example of a regulation release portion and projects upward is formed at the upper surface of the arc-shaped plate 82. Referring to FIG. 21 the contacted portion 88 is at a position where the contacted portion 88 can come into contact with a handle unlocking portion 1*b*, which is an example of a contact portion formed by the front end surface of the front-side frame 1 at the edge of an opening 1*a*, in a state where the inclined holder 31 is moved to the accommodation position.

Therefore, in a state where the inclined holder 31 is pulled out forward from the accommodation position, the handle lock 81 of the first embodiment is held at a lock position functioning as an example of a rotation regulation position where the contacted portion 88 is separated from the front end surface of the front-side frame 1, and the guided portions 83 to 85 come into contact with the rear ends of the slits 72*a* to 72*c* respectively, by the elastic force of the lock spring 87. In this state, the locking portion 83 is moved rearward, and the cartridge handle Kk6 of the held toner cartridge Kk is sandwiched by the locking portion 83 and the cover-side attachment/detachment regulating surface 76*c* and held in a state where rotation is regulated. Referring to FIG. 21, in a state where the inclined holder 31 is moved to the accommodation position, the handle lock 81 is moved to a rotation permission position where the contacted portion 88 comes into contact with the front end surface of the front-side frame 1, and the handle lock 81 is moved forward along the slits 72*a* to 72*c* against the elastic force of the lock spring 87. At the rotation permission position, the locking portion 83 is separated forward from the front end of the cartridge handle Kk6, and the cartridge handle Kk6 is rotated such that the toner cartridge Kk can be rotated.

Operation of First Embodiment

In the image forming apparatus U according to the first embodiment of the invention configured as above, if an image forming operation or a so-called job is carried out, and the developing units GG to GK consume the developer, the toner dispenser device U3*a* is operated in accordance with the amount of consumption, and the developer is replenished from the toner cartridges Kg to Kk. If the developer in the toner cartridges Kg to Kk has been emptied, the toner cartridges Kg to Kk are replaced.

(Description of Removal Operation of Toner Cartridge)

Referring to FIGS. 3A to 3C, when the emptied toner cartridge Kk is replaced, at the accommodation position shown in FIGS. 3A to 3C, the cartridge handle Kk6 of the toner cartridge Kk is operated to rotate the toner cartridge Kk from the outlet port opening position shown in FIG. 3B to the outlet port closing position shown in FIG. 3C. With the rotation of the toner cartridge Kk, the outlet port Kk3 and the inlet port 9 are closed by the cartridge shutter Kk4 and the main-body shutter 12.

If the toner cartridge Kk is rotated to the outlet port closing position, the outlet port portion Kk2 is moved to the shutter passage groove 6, such that the toner cartridge Kk, the guided rails 21 and 22, and the inclined holder 31 can be pulled out forward. If the cartridge handle Kk6 of the toner cartridge Kk is operated to pull out the toner cartridge Kk forward from the accommodation position, as shown in FIGS. 20A to 20C, the handle lock 81 is moved to the rotation regulation position by the elastic force of the lock spring 87, and the cartridge handle Kk6 of the toner cartridge Kk is held in a state where rotation is impossible. Therefore, the rotation of the toner cartridge Kk during the pull-out operation is suppressed, and thus operability is improved.

Referring to FIGS. 3A to 3C and FIG. 4, the toner cartridge Kk which is pulled out forward from the accommodation position shown in FIGS. 3A to 3C can be pulled out to the pull-out position shown in FIG. 4 where the stoppers 24 of the guided rails 21 and 22 come into contact with the screws 19 of the guide rails 16. At the pull-out position, as shown in FIGS. 11A and 11B, the locking portions 42*d* are fitted into the latch holes 51 of the supports 46 and 47, and the inclined holder 31 is held at the insertion possible position shown in FIG. 4 and FIGS. 11A and 11B.

Referring to FIGS. 13 and 15 at the pull-out position, the lock stud 78 of the front cover 71 is fitted into the cover locking portion 56*c* of the lock opening 56. Thus, at the insertion possible position shown in FIG. 4, FIGS. 11A and 11B, and FIG. 13, the front cover 71 is held at the front end closing position shown in FIG. 13 and in a state where rotation is impossible. Therefore, at the insertion possible position, the front cover 71 is prevented from being erroneously moved to the front end opening position and opened. As a result, unexpected trouble is reduced, such as the toner cartridge Kk sliding forward from the inclined holder 31 by the rotation of the inclined holder 31 in a state where the front cover 71 can be rotated.

If the user pulls down the cartridge handle Kk6 at the front end of the toner cartridge Kk which is held at the insertion possible position, the locking portions 42*d* are disengaged from the latch holes 51 against the elastic force of the pin urging springs 43, and start to be moved toward the inclined position on the lower side.

In this case, in the inclined holder 31 of the first embodiment, the one-way hinge 38 is fitted into the holder rotation shaft 32, and only a rotational force smaller than the natural rotational force is transmitted. Thus, when the one-way hinge 38 is not fitted, the rotation speed at the time of the rotation toward the inclined position on the lower side excessively increases due to the weight of the toner cartridge Kk or the inclined holder 31, and the rapidly rotating inclined holder 31 collides, which may cause the articles to be broken or the user to be hurt. Further, unexpected accident may occur, such as the toner cartridge Kk being projected due to rapid rotation. In contrast, according to the first embodiment, the rotation speed is reduced by the one-way hinge 38, and the occurrence of accidents or the like is suppressed.

If the inclined holder 31 is rotated toward the inclined position, the supports 46 and 47 which are connected by the support connection studs 44 are rotated around the support rotation shaft 48 which is disposed at the position away from the holder rotation shaft 32. If the inclined holder 31 and the supports 46 and 47 are rotated, as shown in FIGS. 13, 15, and 16, the support connection stud 44 is relatively moved along the guide groove portion 53 of the inclined stop groove 52 in accordance with the difference in the rotation trajectory of the inclined holder 31 and the supports 46 and 47 with the rotation shafts 32 and 48 misaligned. As shown in FIG. 16, if the support connection stud 44 comes into contact with the lower rotation lock surface 53*b* at the front end of the guide groove portion 53, the rotation of the inclined holder 31 and the supports 46 and 47 is regulated, and further downward inclination is regulated. That is, the movement of the inclined holder 31 to the inclined position shown in FIGS. 5 and 16 is completed, and the supports 46 and 47 are moved to the lower rotation position.

With the front cover 71 which is moved integrally with the inclined holder 31 when the inclined holder 31 is rotated, the lock stud 78 is relatively moved with respect to the lock opening 56 at the front ends of the supports 46 and 47 having a different rotation trajectory from the inclined holder 31, and the lock stud 78 which is fitted into the cover locking portion 56*c* as shown in FIG. 15 comes into contact with the support unlocking portion 56*b*, as shown in FIG. 16. Therefore, if the inclined holder 31 is moved to the inclined position shown in FIG. 16, the front cover 71 can be rotated around the cover rotation shaft 77.

Referring to FIGS. 8A, 8B, and 9, as the inclined holder 31 is rotated, the link 27 which is connected to the right-side link connection pin 36*d* is rotated in interlocking with the inclined holder 31, so the link 27 is moved from the stop portion separation position shown in FIGS. 8A and 8B to the stop portion contact position shown in FIG. 9. Thus, the stopped portion 27*b* comes into contact with the erroneous insertion stop portion 16*a*, and the movement of the guided rails 21 and 22 toward the accommodation position is regulated. Therefore, while the inclined holder 31 is being inclined or the toner cartridge Kk is being replaced, the erroneous movement of the guided rails 21 and 22 or the inclined holder 31 toward the accommodation position is suppressed.

With the inclined holder 31 of the first embodiment, the support rotation shaft 48 of the supports 46 and 47 is disposed close to the holder rotation shaft 32, so the forward projection amount of the guided rails 21 and 22 can be reduced. Therefore, with the cartridge holder KHk of the first embodiment, the user is prevented from being hurt by the projected guided rails 21 and 22, as compared with a case where the guided rails 21 and 22 are projected forward.

If the support rotation shaft 48 is close to the holder rotation shaft 32, the rotation trajectory of the inclined holder 31 approximates to the rotation trajectory of the supports 46 and 47. Thus, there is only a small shift in the relative positions of the supports 46 and 47 with respect to the inclined holder 31 at the inclined position, and the projection amount of the supports 46 and 47 from the lower surface of the inclined holder 31 is reduced. Therefore, unexpected accidents are reduced, such as the user being hurt and the like, by the projected supports 46 and 47.

If the front cover 71 is rotated from the front end closing position shown in FIG. 5 to the front end opening position shown in FIG. 6 in a state where the inclined holder 31 is moved to the inclined position, the lock stud 78 is rotated along the cover stud guide groove 56*a* of the lock opening 56. If the lock stud 78 is separated from the support unlocking portion 56*b* and moved to the cover stud guide groove 56*a*, the supports 46 and 47 are rotated. Then, as shown in FIGS. 14 and 17, the supports 46 and 47 are moved to the rotation regulation position where the support connection stud 44 is fitted into the rotation lock surface 54*a* from the lower rotation lock surface 53*b*. In this state, the movement along the guide groove portion 53 is regulated, and as a result, the supports 46 and 47 cannot be rotated, that is, the inclined holder 31 is held so as not to be rotated from the inclined position toward the insertion possible position. Therefore, the inclined holder 31 is prevented from being erroneously rotated toward the insertion possible position in a state where the front cover 71 is open.

If the front cover 71 is moved to the front end opening position shown in FIG. 6, the cover-side handle rotation port 76*a* is separated from the cartridge handle Kk6, so as shown in FIG. 7, the toner cartridge Kk can be removed from the inclined holder 31. Therefore, with the image forming apparatus U of the first embodiment, when the toner cartridges Kg to Kk which are attached or detached at the upper portion of the image forming apparatus U are attached or detached, even a user who is short or in a wheel chair can easily replace the toner cartridges Kg to Kk, as compared with the related art in which only the movement in the front-back direction is possible and downward inclination is not made, unlike the inclined holder 31.

(Description of Mounting Operation of Toner Cartridge)

Referring to FIG. 7, when a new toner cartridge Kk is mounted, the cartridge handle Kk6 is guided to the holder-side handle rotation port 63*a* and the holder-side attachment/detachment regulating surface 63*c*, and then the new toner cartridge Kk is mounted on the cartridge holding surface 62*a*, as shown in FIG. 6. As shown in FIG. 6, in a state where the front cover 71 is moved to the front end opening position, the rotation lock surface 54*a* and the support connection stud 44 come into contact with each other, and the inclined holder 31 cannot be rotated. Further, the stopped portion 27*b* of the link 27 and the insertion prevention stop portion 16*a* come into contact with each other, and insertion is impossible. Therefore, in a state where the user forgets to close the front cover 71, the inclined holder 31 is prevented from being rotated or inserted.

Referring to FIGS. 5 and 6, if the front cover 71 is rotated toward the front end closing position, the front cover 71 is moved to the front end closing position shown in FIG. 16 via the state shown in FIG. 17. At the front end closing position shown in FIG. 16 the support connection stud 44 comes into contact with the lower rotation lock surface 53*b*, and the rotation upward from the supports 46 and 47 is possible. In this state, the stopped portion 27*b* of the link 27 and the insertion prevention stop portion 16*a* come into contact with each other, and the guided rails 21 and 22 are held in a state where insertion is impossible.

If the front cover 71 is moved to the front end closing position, the cartridge handle Kk6 is sandwiched by the locking portion 83 and the cover-side attachment/detachment regulating surface 76*c*, such that the rotation is regulated. Therefore, when the user holds and operates the cartridge handle Kk6, the possibility that an unintended operation is made due to the cartridge Kk being rotated with respect to the inclined holder 31 is reduced.

Referring to FIGS. 4 and 5, if the inclined holder 31 is rotated upward from the inclined position shown in FIG. 5, the inclined holder 31 is moved toward the insertion possible position shown in FIG. 4. In this case, the one-way hinge 38 which is fitted into the holder rotation shaft 32 of the first embodiment does not limit the rotational force with regard to the rotation direction from the inclined position toward the insertion possible position. Therefore, when the user rotates the inclined holder 31 from the lower side to the upper side, a load is not applied to limit the user's force for rotation, as compared with a case where a regulating member is used to limit the rotational force in the two rotation directions as well as the one rotation direction, and thus the user can easily rotate the inclined holder 31 to the insertion possible position. Even if the user takes his/her hand off the inclined holder 31 while the inclined holder 31 is being raised to the insertion possible position, the rotational force is limited with regard to the rotation from the insertion possible position toward the inclined position, so rapid dropping is suppressed and the occurrence of accidents, such as the user being hurt and the like, is reduced.

With the inclined holder 31 of the first embodiment, the rear end protection portion 64*a* of the left cover 64 fills the gap between the left-side wall 36*b* and the left-side guided rail 21, so accidents, such as a finger being erroneously caught between the guided rail 21 and the left cover 64 during the rotation operation, are reduced.

If the inclined holder 31 is moved to the insertion possible position shown in FIG. 4, as shown in FIGS. 11A and 11B, the locking portions 42*d* are fitted into the latch holes 51 of the supports 46 and 47, so the operator can recognize that the inclined holder 31 has been moved to the insertion possible position. Even if the operator tries to further rotate the inclined holder 31 upward from the insertion possible position, as shown in FIGS. 11A, 11B, and 13, the support connection stud 44 comes into contact with the upper rotation lock surface 53*a* of the guide groove portion 53. Therefore, the rotation upward from the supports 46 and 47 is regulated, and the rotation upward from the insertion possible position of the inclined holder 31 is regulated.

At the insertion possible position, the lock stud 78 of the front cover 71 is fitted into the cover locking portion 56*c*, so the front cover 71 is prevented from being erroneously opened at the front end opening position.

Further, at the insertion possible position, the link 27 is moved to the stop portion separation position shown in FIGS. 8A and 8B, and the stopped portion 27*b* is separated from the erroneous insertion stop portion 16*a*, such that the guided rails 21 and 22 can be moved toward the accommodation position on the rear side.

Referring to FIGS. 3A to 3C and FIG. 4, if the user pushes the cartridge handle Kk6 from the insertion possible position shown in FIG. 4, as shown in FIGS. 20A to 20C, the push-in rib Kk7 of the toner cartridge Kk comes into contact with the rib contact portion 62*b* of the upper-side cover 62, so the inclined holder 31 and the guided rails 21 and 22 are moved to the accommodation position on the rear side shown in FIGS. 3A to 3C, together with the toner cartridge Kk.

In this case, in the toner cartridge Kk of the first embodiment, the cartridge handle Kk6 is held while being sandwiched between the locking portion 83 and the cover-side attachment/detachment regulating surface 76*c*, and the outlet port portion Kk2 is positioned to correspond to the shutter passage groove 6. Therefore, the outlet port portion Kk2 can pass through the shutter passage groove 6 and be moved to the accommodation position without interference.

Referring to FIG. 21, if the inclined holder 31 and the like are moved from the insertion possible position to the accommodation position, and the contacted portion 88 of the handle lock 81 comes into contact with the front end surface of the front-side frame 1 at the edge of the opening 1*a*, relative movement with respect to the front cover 71 is carried out against the elastic force of the lock spring 87. Therefore, as shown in FIG. 21, if the inclined holder 31 and the like are moved to the accommodation position, the handle lock 81 is held at the position projected forward from the cartridge handle Kk6, such that the cartridge handle Kk6 can be rotated with respect to the inclined holder 31.

Referring to FIGS. 3A to 3C, in a state where the movement to the accommodation position is made and the rotation regulation of the cartridge handle Kk6 by the handle lock 81 is released, if the cartridge handle Kk6 is rotated, the movement is made from the outlet port closing position shown in FIG. 3C to the outlet port opening position shown in FIG. 3B, and the outlet port Kk3 and the inlet port 9 are opened and connected to each other. Therefore, the developer can be supplied from the toner cartridge Kk to the reserve tank RTk.

Second Embodiment

Figure 22:
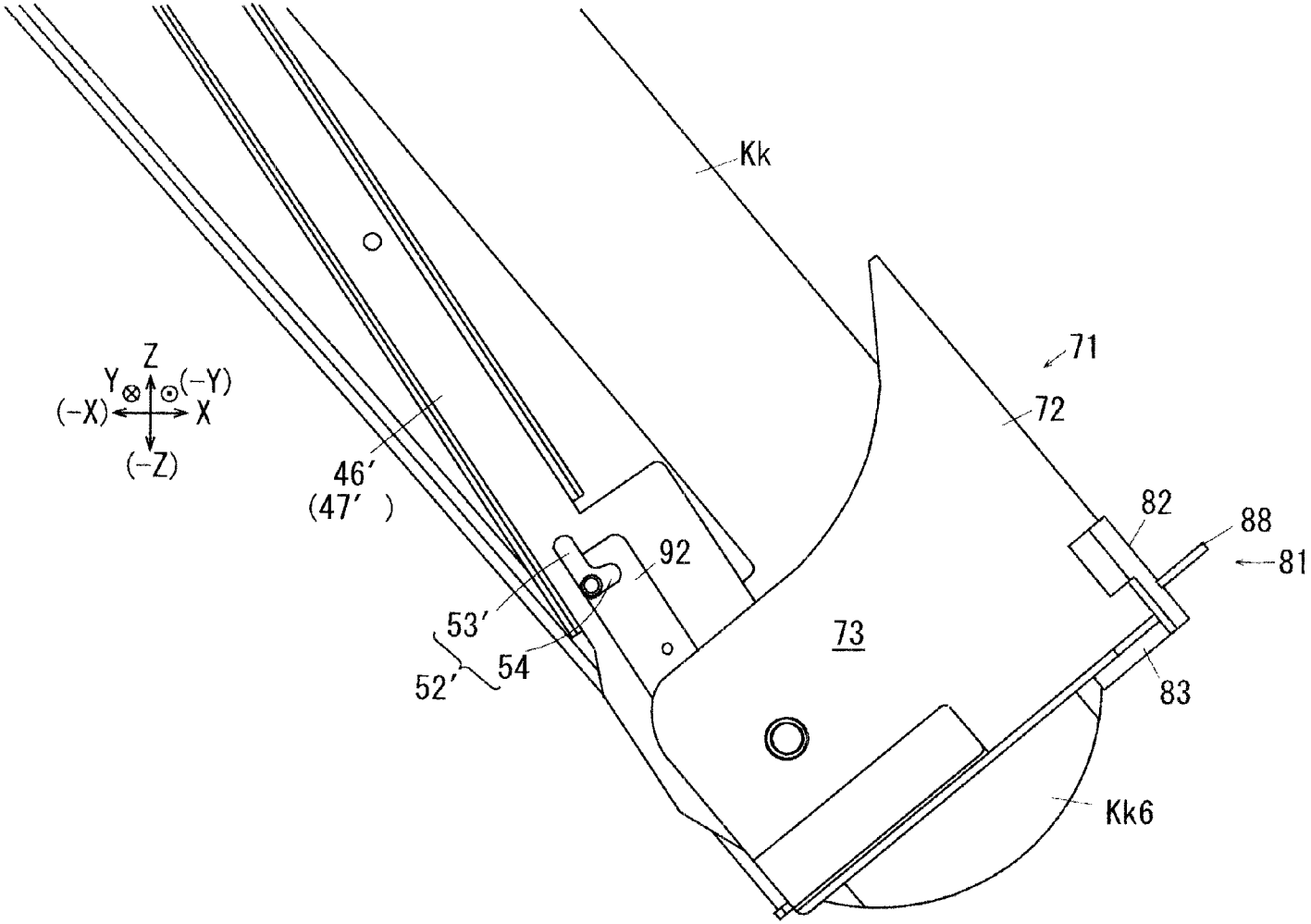
FIG. 22 is an explanatory view of a lower rotation regulating portion and a rotation regulating portion according to a second exemplary embodiment and is a diagram corresponding to FIG. 16 of the first exemplary embodiment.

FIG. 22 is an explanatory view of a lower rotation regulating portion and a rotation regulating portion according to a second exemplary embodiment, and is a diagram corresponding to FIG. 16 of the first embodiment.

Figure 23A:
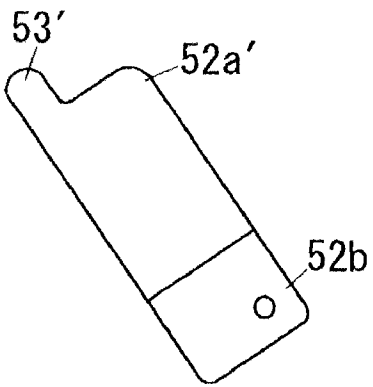
FIGS. 23A to 23D are explanatory views of a rotation position adjusting member according to the second exemplary embodiment, specifically.
Figure 23B:
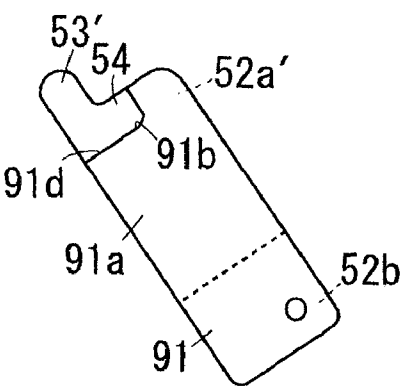
Figure 23B:
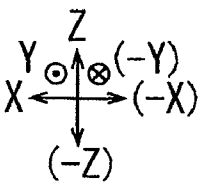
Figure 23C:
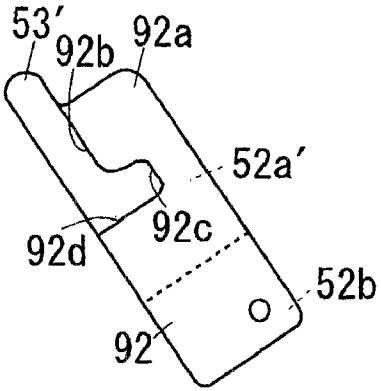
Figure 23D:
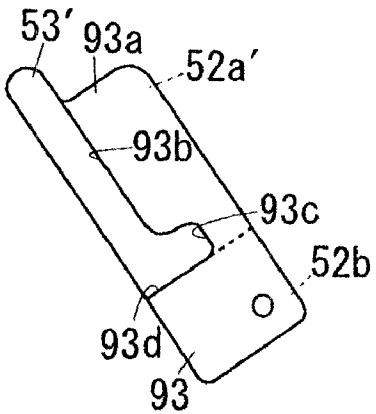

FIGS. 23A to 23D are explanatory views of a rotation position adjusting member according to the second embodiment, specifically. FIG. 23A is an explanatory view of an opening for rotation position adjustment when the rotation position adjusting member is removed, FIG. 23B is an explanatory view of a rotation position adjusting member for a shallow rotation position, FIG. 23C is an explanatory view of a rotation position adjusting member for a middle rotation position, and FIG. 23D is an explanatory view of a rotation position adjusting member for a deep rotation position.

Next, a second embodiment of the invention will be described. In the description of the second embodiment, the members corresponding to the members of the first embodiment are represented by the same reference numerals, and detailed descriptions thereof will be omitted.

This embodiment is different from the first embodiment in terms of the following points, and other points are the same as in the first embodiment.

Referring to FIGS. 22 to 23D, with an inclined holder 31 of the second embodiment, at the front portions of supports 46' and 47', instead of the L-shaped inclined stop grooves 52 of the first embodiment, substantially rectangular inclined stop grooves 52' are formed. In FIG. 23A, the inclined stop grooves 52' of the second embodiment have a guide groove portion 53', corresponding to the guide groove portion 53 of the first embodiment, which extends in the front-back direction, and a rectangular rotation adjusting port 52*a'* which is formed continuously to the front end of the guide groove portion 53' and has a width in the up-down direction corresponding to the length in the up-down direction of the rotation regulating groove portion 54 of the first embodiment. Ahead of the rotation adjusting port 52*a'*, an adjusting member mounting portion 52*b* is formed.

One of a plate-shaped shallow rotation adjusting plate 91 shown in FIG. 23B, a middle rotation adjusting plate 92 shown in FIG. 23C, a deep rotation adjusting plate 93 shown in FIG. 23D, which are an example of a rotation adjusting member, is selectively detachably supported by the adjusting member mounting portion 52*b*.

In FIG. 23B, the shallow rotation adjusting plate 91 has an adjusting plate main body 91*a* which closes the front side of the rotation adjusting port 52', and a shallow rotation groove forming portion 91*b* which is formed by cutting the rear end portion of the adjusting plate main body 91*a* and forms a rotation regulating groove portion 54 in the gap from the rotation adjusting port 52*a'*. Therefore, with the adjusting plate main body 91*a* of the second embodiment, a corresponding surface of the shallow rotation groove forming portion 91*b* ahead of the guide groove portion 53' forms a lower rotation lock surface 91*d* which is an example of a lower rotation regulating portion.

In FIG. 23C, the middle rotation adjusting plate 92 has an adjusting plate main body 92*a* which closes the rotation adjusting port 52*a'*, a guide groove extended portion 92*b* which has a groove, which is connected to the front end of the guide groove portion 53' and extends forward on the extension line, and a middle rotation regulating groove portion 92*c* which is connected to the front end of the guide groove extended portion 92*b* and extends upward. Therefore, with the adjusting plate main body 92*a* of the second embodiment, the connection portion of the guide groove extended portion 92*b* and the middle rotation regulating groove portion 92*c* forms a lower rotation lock surface 92*d* which is an example of a lower rotation regulating portion.

In FIG. 23D, the deep rotation adjusting plate 93 has an adjusting plate main body 93*a* which closes the rotation adjusting port 52*a'*, a guide groove extended portion 93*b* which has a groove, which is connected to the front end of the guide groove portion 53' and extends to the front end of the rotation adjusting port 52*a'* on the extension line, and a deep rotation regulating groove portion 93*c* which extends upward from the front end of the guide groove extended portion 93*b*. Therefore, with the adjusting plate main body 93*a* of the second embodiment, the connection portion of the guide groove extended portion 93*b* and the deep rotation regulating groove portion 93*c* forms a lower rotation lock surface 93*d* which is an example of a lower rotation regulating portion.

Therefore, according to the second embodiment, the total length of the guide groove portion 53' and the guide groove extended portions 92*b* and 93*b* when the middle rotation adjusting plate 92 is mounted is larger than that when the shallow rotation adjusting plate 91 is mounted. Further, the total length of the guide groove portion 53' and the guide groove extended portions 92*b* and 93*b* when the deep rotation adjusting plate 93 is mounted is larger than that when the middle rotation adjusting plate 92 is mounted.

Operation of Second Embodiment

With the image forming apparatus U of the second embodiment configured as above, if the shallow rotation adjusting plate 91 is mounted on the rotation position adjusting member mounting portion 52*b*, when the inclined holder 31 is inclined, the inclined holder 31 stops at the inclined position where the support connection stud 44 comes into contact with the lower rotation lock surface 91*d* at the front end of the guide groove portion 53'.

When the middle rotation adjusting plate 92 is mounted, the inclined holder 31 stops at the inclined position where the support connection stud 44 passes through the guide groove portion 53' and comes into contact with the lower rotation lock surface 92*d* at the front end of the guide groove extended portion 92*b*. Therefore, the inclined position when the middle rotation adjusting plate 92 is mounted has a rotation angle from the insertion possible position larger than the inclined position when the shallow rotation adjusting plate 91 is mounted.

Similarly, when the deep rotation adjusting plate 93 is mounted, the inclined holder 31 stops at the inclined position where the support connection stud 44 passes through the guide groove portion 53' and comes into contact with the lower rotation lock surface 93*d* at the front end of the guide groove extended portion 93*b*. Therefore, the inclined position when the deep rotation adjusting plate 93 is mounted has a rotation angle from the insertion possible position larger than the inclined position when the middle rotation adjusting plate 92 is mounted.

As a result, with the image forming apparatus U of the second embodiment, if the rotation adjusting plates 91 to 93 are attached or detached, the inclination angle of the inclined holder 31 at the inclined position varies, so the inclined position can be changed and adjusted depending on the needs of the user.

Third Embodiment

Figure 24:
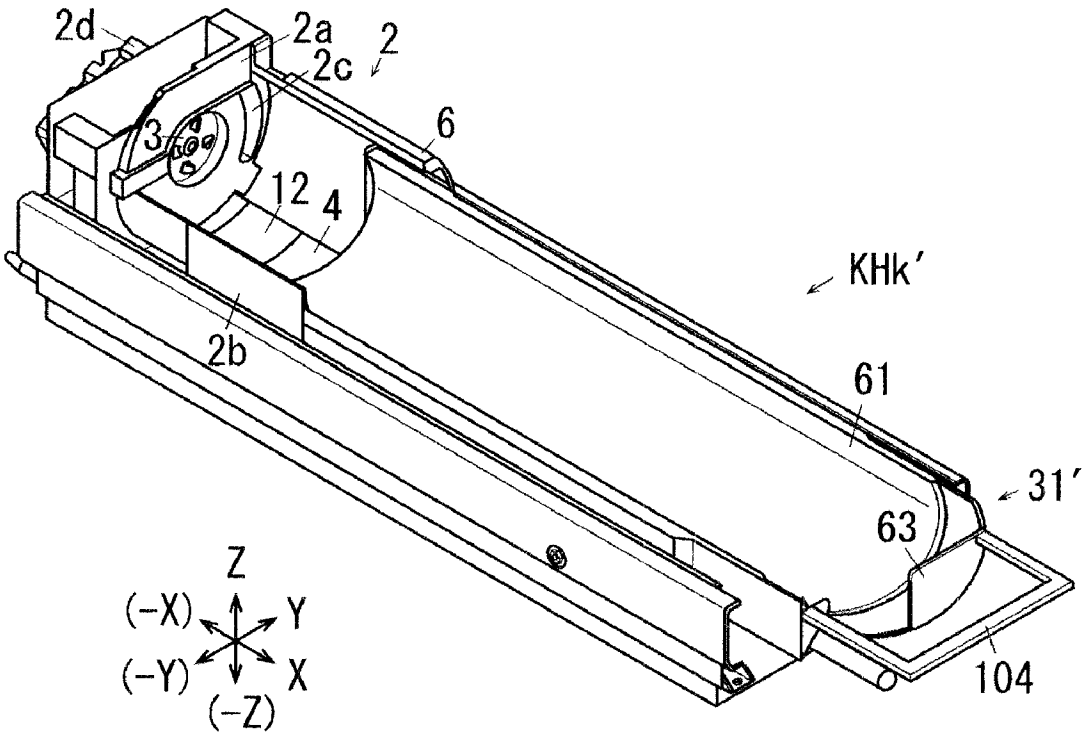
FIG. 24 is an explanatory view of a state where an inclined holder of a third exemplary embodiment is moved to the accommodation position, and a diagram corresponding to FIGS. 3A to 3C of the first exemplary embodiment.

FIG. 24 is an explanatory view of a state where an inclined holder of a third exemplary embodiment is moved to the accommodation position, and a diagram corresponding to FIGS. 3A to 3C of the first embodiment.

Figure 25:
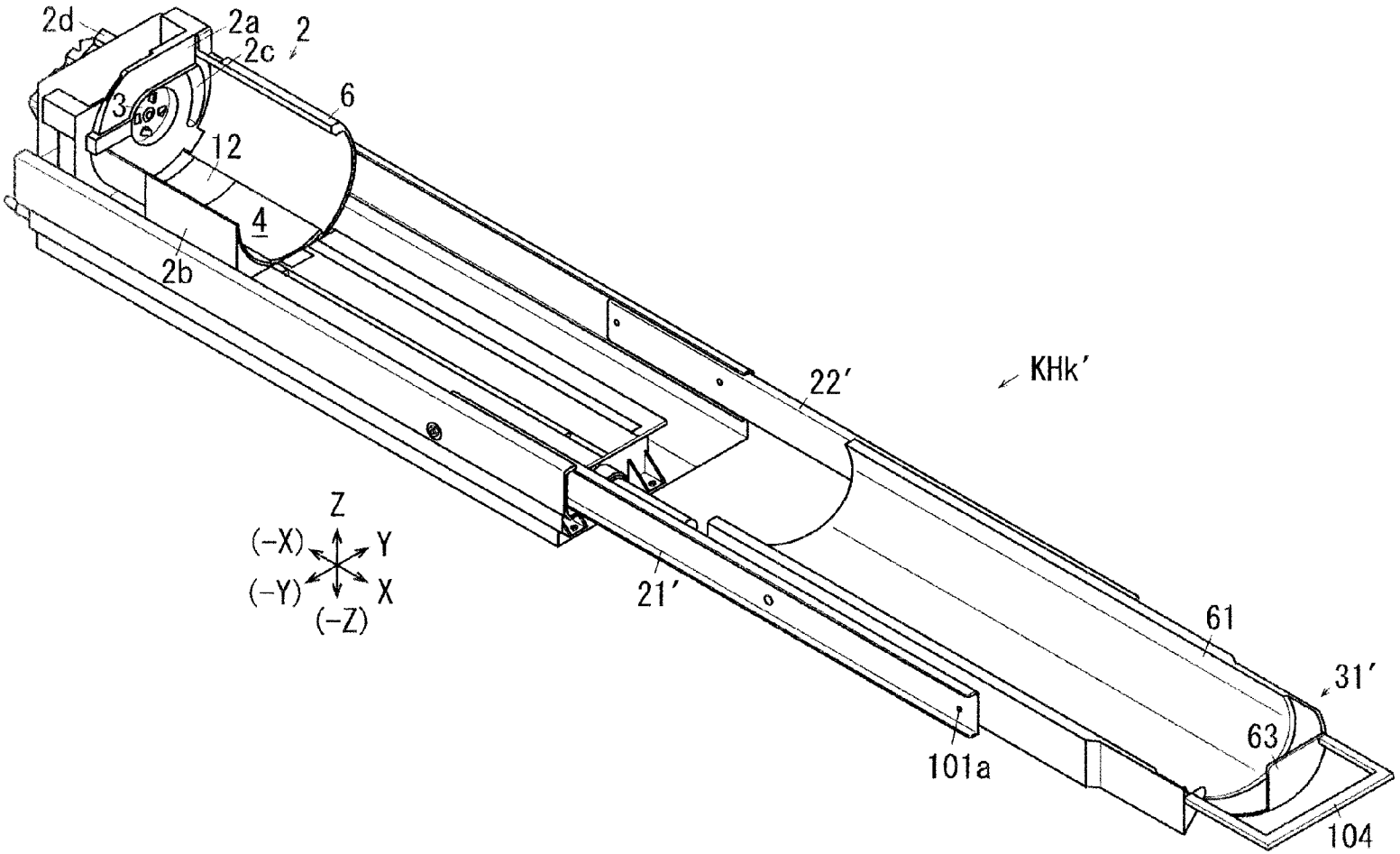
FIG. 25 is an explanatory view of a state where the inclined holder of the third exemplary embodiment is moved to the pull-out position, and a diagram corresponding to FIG. 4 of the first exemplary embodiment.

FIG. 25 is an explanatory view of a state where the inclined holder of the third embodiment is moved to the pull-out position, and a diagram corresponding to FIG. 4 of the first embodiment.

Figure 26:
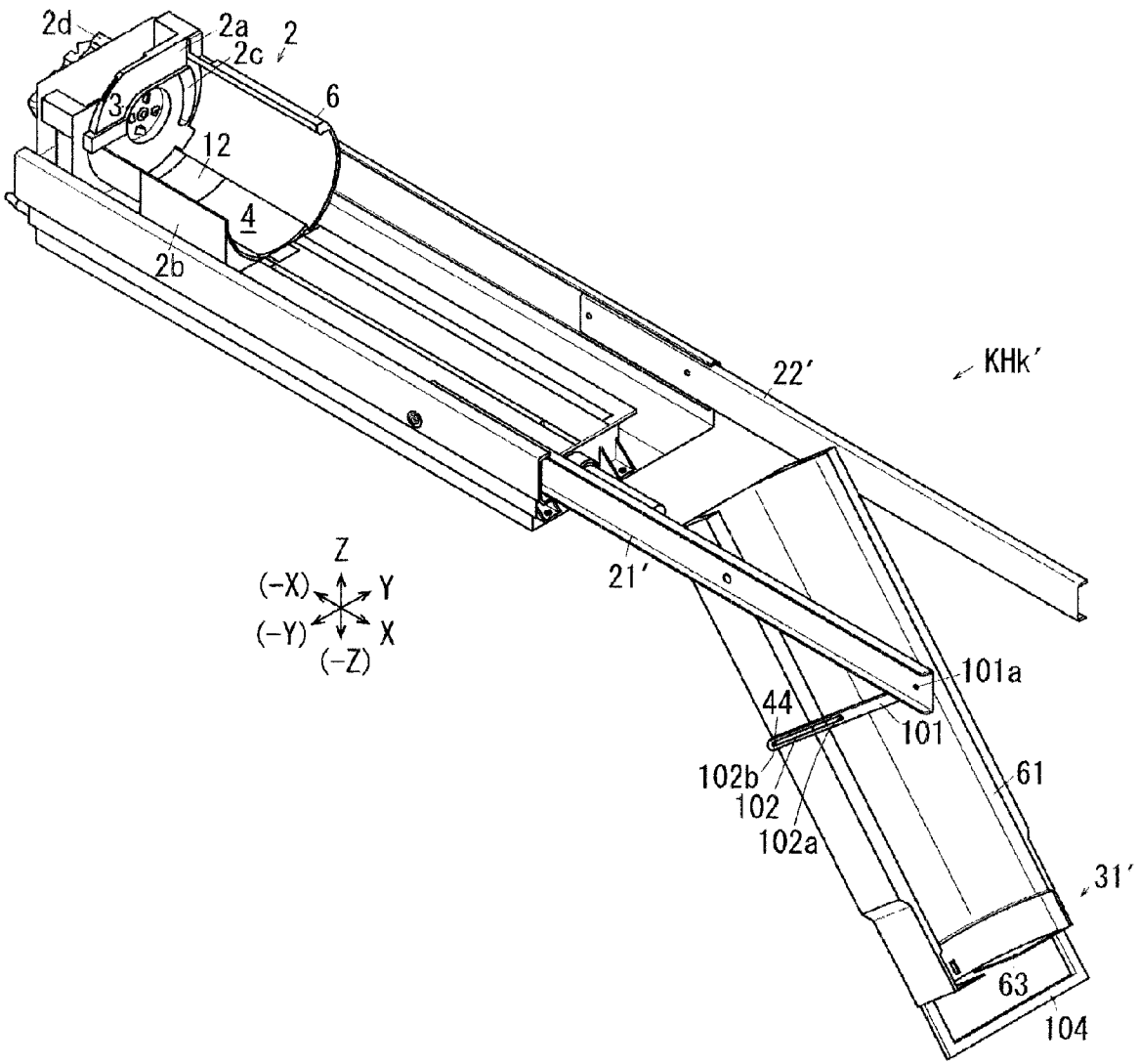
FIG. 26 is an explanatory view of a state where the inclined holder of the third exemplary embodiment is moved to the inclined position, and a diagram corresponding to FIG. 5 of first exemplary embodiment.

FIG. 26 is an explanatory view of a state where the inclined holder of the third embodiment is moved to the inclined position, and a diagram corresponding to FIG. 5 of first embodiment.

Next, a third embodiment of the invention will be described. In the description of the third embodiment, the members corresponding to the members of the first embodiment are represented by the same reference numerals, and detailed descriptions thereof will be omitted.

This embodiment is different from the first embodiment in terms of the following points, and other points are the same as in the first embodiment.

In FIGS. 24 to 26, the toner cartridges are not shown.

Referring to FIGS. 24 to 26, with a cartridge holder KHk of the third embodiment, guided rails 21' and 22' are formed longer in the front-back direction than the guided rails 21 and 22 of the first embodiment.

In FIG. 26, with the cartridge holder KHk' of the third embodiment, instead of the supports 46 and 47 of the first embodiment, a support 101 is provided which connects the front end portion of the left-side guided rail 21' and the front end portion of the inclined holder 31. The support 101 is configured such that a base end portion thereof which is an example of one end portion is supported by the guided rail 21' so as to be rotatable around a support rotation shaft 101*a*. A long hole-shaped guide groove portion 102 which corresponds to the guide groove portion 53 of the first embodiment is formed at a front end portion of the support 101 which is an example of the other end portion and extends along the support 101. On the support rotation shaft 101*a* side of the guide groove portion 102, an upper rotation lock surface 102*a* is formed which corresponds to the upper rotation lock surface 53*a* of the first embodiment. On the opposite side to the upper rotation lock surface 102*a* a lower rotation lock surface 102*b* is formed which corresponds to the lower rotation lock surface 53*b* of the first embodiment.

A support connection stud 103 which corresponds to the support connection stud 44 of the first embodiment and which projects outward is supported while being fitted into the guide groove portion 102 of the support 101. Therefore, the inclined holder 31 of the third embodiment is supported by the guided rails 21' and 22' so as to be movable between the insertion permission position shown in FIG. 25 and the inclined position shown in FIG. 26 where the support connection stud 103 comes into contact with the lower rotation lock surface 102*b*.

With the inclined holder 31 of the third embodiment, the front cover 71 is not provided, and a knob-shaped holder handle 104 is formed integrally at the front end of a holder cover 61' to extend forward. Therefore, according to the third embodiment, a mechanism is not provided for locking at the inclined position by the interlocking of the rotation of the front cover 71 and the supports 46 and 47, or for locking the rotation of the front cover 71 at the insertion possible position in the first embodiment. Further, according to the third embodiment, a pull-out regulating member is formed only by a front end wall 63 of the holder cover 61.

Operation of Third Embodiment

With the cartridge holder KHk' of the third embodiment configured as above, similarly to the first embodiment, the guided rails 21' and 22' are moved between the accommodation position shown in FIG. 24 and the pull-out position shown in FIG. 25, and the inclined holder 31 is moved between the insertion permission position shown in FIG. 25 and the inclined position shown in FIG. 26. Therefore, the toner cartridge Kk can be replaced at the inclined position inclined downward from the pull-out position.

(Modifications)

Although the embodiments of the invention have been described in detail, the invention is not limited to the embodiments, and various modifications may be made without departing from the gist of the invention described in the appended claims. The modifications (H01) to (H014) of the invention will be described below.

(H01) Although in the foregoing embodiments, the image forming apparatus U is a so-called multi-function apparatus, but the invention is not limited thereto. For example, the image forming apparatus U may be a printer, a facsimile machine, or the like.

(H02) Although in the foregoing embodiments, the image forming apparatus U may use toner of five or less colors, or toner of seven or more colors, instead of toner of six colors.

(H03) Although in the foregoing embodiments, toner of six colors of G: green, O: orange, Y: yellow, M: magenta, C: cyan, and K: black are used, the invention is not limited thereto. For example, instead of toner of G: green and O: orange, toner of other colors than the above-described six colors may be used. In addition, colorless toner which is used to coat an image surface for waterproofing or protection, toner of a color representative of an organization, such as a company or an association, which is a so-called corporate color, or magnetic toner which is used to form a predetermined shape or arrangement in an image on a printing sheet for antitheft, for example, a linear magnetic wire may be used. An antitheft device which detects magnetic pulses generated from the magnetic wire is known, as described in JP-A-2006-256124 or the like, for example.

(H04) In the foregoing embodiments, the one-way hinge which is an example of a regulating member is used. Although it is desirable to use a one-way hinge, a torque limiter which carries out braking in the forward and backward directions may be used. In addition, a buffer device or a so-called damper in which load resistance increases as the speed increases may be used as a regulating member.

(H05) Although in the foregoing embodiments, the rail-shaped guided rails 21, 22, 21', and 22' functioning as an example of a pull-out member have been illustrated, the invention is not limited thereto. For example, a so-called slider or the like may be used which is known and movable in the pull-out direction.

(H06) Although in the foregoing embodiments, the toner cartridges Kg to Kk are configured such that the cartridge shutter Kk4 is moved in the circumferential direction along the circumferential surface, the invention is not limited thereto. For example, the cartridge shutter Kk4 may be moved along the pull-out direction, and opened/closed when being moved between the pull-out position and the accommodation position. In this case, the toner cartridge does not need to rotate on the holder main body 36+61 so the handle rotation ports 63*a* and 76*a* may be formed to have a groove shape in the up-down direction through which the handle Kk6 can pass, not a fan shape, and the handle lock 81 does not have to be provided.

(H07) In the foregoing embodiments, desirably, the link 27 is provided, and the guided rails 21 and 22 are held at the pull-out position in a state where the inclined holder 31 is not moved to the insertion possible position, but the link 27 does not have to be provided.

(H08) In the foregoing embodiments, desirably, the locking of the locking portions 42*d* and the latch holes 51 ensures the user perceives the movement to the insertion possible position, or assists the inclined holder 31 to be held at the insertion possible position, but the locking portions 42*d* and the latch holes 51 do not have to be provided. Further, although the combination of the pins 42 and the latch holes 51 is used, but the invention is not limited thereto. For example, the combinations of known members, such as claws and holes, claws and pins, and the like may be used. In addition, although the pins 42 are provided in the holder frame 36 and the latch holes 51 are provided in the supports 46 and 47, latch holes may be provided in the holder frame 36 and pins may be provided in the supports.

(H09) In the foregoing embodiments, desirably, the rotation lock surfaces 54*a* and the support connection studs 44 are fitted with each other by interlocking of the rotation of the supports 46 and 47 and the front cover 71, and if the front cover 71 is not moved in the front end closing position, the inclined holder 31 is locked so as not to be rotated, but the rotation lock surfaces 54*a* and the support connection studs 44 do not have to be provided.

(H010) Although in the foregoing embodiments, the push-in rib Kk7 and the rib contact portion 62*b* come into contact with each other, and the cartridge handle Kk6 is operated to be moved from the pull-out position to the accommodation position, the invention is not limited thereto. An arbitrary push-in configuration may be used. For example, the front end of the toner cartridge Kk may be covered with the front cover, and an operating portion may be provided in the front cover 71 or the like to push the front cover 71, such that the movement toward the accommodation position can be made.

(H011) In the foregoing embodiments, desirably, the holder cover 61 is provided, but the holder cover 61 may not be provided. The respective portions of the holder cover 61 may be provided in the holder frame 36.

(H012) Although in the foregoing embodiments, the lock studs 78 and the lock openings 56 ensure the interlocking of the rotation of the front cover 71 and the supports 46 and 47, the lock studs 78 and the lock openings 56 do not have to be provided, such that the front cover 71 and the supports 46 and 47 may be moved independently. Further, the invention is not limited to the combination of the studs 78 and the openings 56, and an arbitrary interlocking mechanism may be used. The studs 78 may be provided in the supports 46 and 47, and the openings may be provided in the front cover.

(H013) In the foregoing embodiments, the shape and the like of the handle lock 81 are not limited to the configuration illustrated in the embodiments. The shape and the like of the handle lock 81 may be changed in accordance with design or specification.

(H014) In the foregoing embodiments, when each of the toner cartridges Kk to Kg passes through the handle passage port 63*b* and is mounted, there is a possibility that the rotation position is shifted from the outlet port closing position to the outlet port opening position. In order to cope with this situation, a mechanism which rotates the toner cartridges Kk to Kg to the outlet port closing position when the front cover 71 is closed is desirably incorporated. For example, a cam may be provided in the handle lock 81 to come into contact with the front ends of the toner cartridges Kk to Kg to rotate the toner cartridges Kk to Kg, such that the movement to the outlet port closing position may be made in accordance with the closing operation of the front cover 71.

What is claimed is:

1. A removable member-holding device comprising:

a pull-out member that is supported so as to be movable between an accommodation position where the pull-out member is accommodated in an image forming apparatus main body and a pull-out position where the pull-out member is pulled out from the accommodation position outward of the image forming apparatus main body;

a rotatable holder that is supported by the pull-out member so as to be rotatable around a rotation shaft and supported so as to be movable integrally with the pull-out member, and that holds a removable member which is attached to and detached from the image forming apparatus main body, wherein the rotatable holder is movable between an insertion possible position where the pull-out member is movable from the pull-out position toward the accommodation position and an inclined position where the rotatable holder rotates downward in a direction of a gravity around the rotation shaft and is inclined with respect to the insertion possible position; and a regulating member that is disposed at the rotation shaft of the rotatable holder to lessen a rotation speed of the rotatable holder when rotationally moving to the inclined position:

wherein the removable member includes a container to which supplies of an image forming apparatus is filled.

2. The removable member-holding device according to claim 1, wherein the regulating member includes an overload protection device that, when a rotational force equal to or larger than a predetermined rotational force is applied, interrupts transmission of the rotational force equal to or larger than the predetermined rotational force, and the predetermined rotational force is set to a value smaller than a natural rotational force for rotating the rotatable holder due to the gravity.

3. The removable member-holding device according to claim 2, wherein the overload protection device includes a transmission interruption device that transmits a rotational force in a reverting rotation direction which is a rotation direction from the inclined position toward the insertion possible position, and that, when a rotational force in an inclined rotation direction which is a rotation direction from the insertion possible position toward the inclined position is equal to or larger than the predetermined rotational force, interrupts the transmission of the rotational force equal to or larger than the predetermined rotational force.

4. A removable member-holding device comprising:

a pull-out member that is supported so as to be movable between an accommodation position where the pull-out member is accommodated in an image forming apparatus main body and a pull-out position where the pull-out member is pulled out from the accommodation position outward of the image forming apparatus main body;

a rotatable holder that has a holder main body which extends along a movement direction of the pull-out member and which holds a removable member to be attached to and detached from the image forming apparatus main body, and that is supported by the pull-out member so as to be rotatable around a rotation shaft, wherein the rotatable holder is movable between an insertion possible position where the pull-out member is movable from the pull-out position toward the accommodation position and an inclined position where the rotatable holder rotates downward in a direction of a gravity around the rotation shaft and is inclined with respect to the insertion possible position;

a rotation regulating portion that is provided at a position away from the rotation shaft of the rotatable holder;

an auxiliary rotator that extends along the movement direction of the pull-out member and that is supported so as to be rotatable around an auxiliary rotation shaft at a position away from the rotation shaft of the rotatable holder; and a lower rotation regulating portion that is provided at a position away from the auxiliary rotation shaft of the auxiliary rotator, wherein the lower rotation regulating portion is engaged with the rotation regulating portion of the rotatable holder, which has been moved to the inclined position, to hold the rotatable holder at the inclined position and regulates further rotation of the rotatable holder downward from the inclined position in the direction of the gravity.

5. The removable member-holding device according to claim 4, wherein the lower rotation regulating portion is supported such that the position thereof is changeable with respect to the rotatable holder, and the lower rotation regulating portion changes a rotation angle of the rotatable holder from the insertion possible position when being engaged with the rotation regulating portion, so as to change the inclined position of the rotatable holder.

6. The removable member-holding device according to claim 4, wherein the auxiliary rotator is disposed such that the auxiliary rotation shaft is close to the rotation shaft of the rotatable holder.

7. A removable member-holding device comprising:

a pull-out member that is supported so as to be movable between an accommodation position where the pull-out member is accommodated in an image forming apparatus main body and a pull-out position where the pull-out member is pulled out from the accommodation position outward of the image forming apparatus main body;

a rotatable holder that has a holder main body which extends along a movement direction of the pull-out member and which holds a removable member to be attached to and detached from the image forming apparatus main body, and that is supported by the pull-out member so as to be rotatable around a rotation shaft, wherein the rotatable holder is movable between an insertion possible position where the pull-out member is movable from the pull-out position toward the accommodation position and an inclined position where the rotatable holder rotates downward in a direction of a gravity around the rotation shaft and is inclined with respect to the insertion possible position;

a rotation regulating portion that is provided at a position away from the rotation shaft of the rotatable holder;

an auxiliary rotator that extends along the movement direction of the pull-out member and that is supported so as to be rotatable around an auxiliary rotation shaft at a position away from the rotation shaft of the rotatable holder; and an upper rotation regulating portion that is provided at a position away from the auxiliary rotation shaft of the auxiliary rotator, and that is engaged with the rotation regulating portion of the rotatable holder, which has been moved to the insertion possible position, to regulate further rotation of the rotatable holder upward from the insertion possible position in the direction of the gravity.

8. The removable member-holding device according to claim 4, further comprising:

an interlocking member that has a stopped portion and that is connected to the rotatable holder, wherein the stopped portion is moved to a separation position where the stopped portion is separated from an erroneous insertion stop portion formed in the image forming apparatus main body in a state where the rotatable holder has been moved to the insertion possible position, so as to permit the movement of the pull-out member, and the stopped portion is moved to a contact position where the stopped portion comes into contact with the erroneous insertion stop portion in a state where the rotatable holder has been moved to the inclined position, so as to inhibit the movement of the pull-out member.

9. The removable member-holding device according to claim 4, further comprising:

a locked portion formed in the auxiliary rotator and disposed at a position away from the auxiliary rotation shaft; and a locking portion is disposed in the rotatable holder, the locking portion being separated from the locked portion of the auxiliary rotator, which rotates in interlocking with the rotatable holder, in a state where the rotatable holder has been moved to the inclined position, and the locking portion is locked to the locked portion in a state where the rotatable holder has been moved to the insertion possible position.

10. An image forming apparatus comprising:

an image carrier;

a developing unit that develops on a latent image on a surface of the image carrier into a visible image;

a removable member having a developer accommodating container, which accommodates a developer to be replenished to the developing unit; and a removable member-holding device according to claim 1.

11. An image forming apparatus comprising:

an image carrier;

a developing unit that develops on a latent image on a surface of the image carrier into a visible image;

a removable member having a developer accommodating container, which accommodates a developer to be replenished to the developing unit; and a removable member-holding device according to claim 2.

12. An image forming apparatus comprising: an image carrier;

a developing unit that develops on a latent image on a surface of the image carrier into a visible image;

a removable member having a developer accommodating container, which accommodates a developer to be replenished to the developing unit; and a removable member-holding device according to claim 3.

13. An image forming apparatus comprising:

an image carrier;

a developing unit that develops on a latent image on a surface of the image carrier into a visible image;

a removable member having a developer accommodating container, which accommodates a developer to be replenished to the developing unit; and a removable member-holding device according to claim 4.

14. An image forming apparatus comprising:

an image carrier;

a developing unit that develops on a latent image on a surface of the image carrier into a visible image;

a removable member having a developer accommodating container, which accommodates a developer to be replenished to the developing unit; and a removable member-holding device according to claim 5.

* * * * *